US007252359B2

(12) United States Patent
Udagawa

(10) Patent No.: US 7,252,359 B2
(45) Date of Patent: Aug. 7, 2007

(54) INKJET RECORDING DEVICE AND RECOVERY PROCESSING METHOD

(75) Inventor: Kenichi Udagawa, Ibaraki (JP)

(73) Assignee: Canon Finetech Inc., Ibaraki (JP)

( * ) Notice: Subject to any disclaimer, the term of this patent is extended or adjusted under 35 U.S.C. 154(b) by 51 days.

(21) Appl. No.: 11/228,708

(22) Filed: Sep. 16, 2005

(65) Prior Publication Data

US 2006/0061617 A1 Mar. 23, 2006

(30) Foreign Application Priority Data

Sep. 22, 2004 (JP) ..... 2004-274412
Nov. 29, 2004 (JP) ..... 2004-343469

(51) Int. Cl.
*B41J 2/175* (2006.01)
*B41J 2/18* (2006.01)
*B41J 2/185* (2006.01)

(52) U.S. Cl. ..... 347/19; 347/9; 347/23; 347/33

(58) Field of Classification Search ..... 347/19, 347/23

See application file for complete search history.

(56) References Cited

U.S. PATENT DOCUMENTS 5,583,547 A * 12/1996 Gast et al. ..... 347/22
6,382,764 B1 * 5/2002 Shimoda ..... 347/23
6,786,566 B2 * 9/2004 Shindo ..... 347/30
2004/0165030 A1 * 8/2004 Sakamoto et al. ..... 347/23

* cited by examiner

*Primary Examiner*—Manish S. Shah
*Assistant Examiner*—Mark J Stevenosky, Jr.
(74) *Attorney, Agent, or Firm*—patenttm.us; James H. Walters

(57) ABSTRACT

An inkjet recording device according to the present invention performs preliminary ejection, not at an interval of fixed time but at a time detected by the inkjet recording device, to reduce the number of preliminary ejection for high-quality image recording or to reduce the number of preliminary ejection and the required time for higher throughput and faster image recording. A setting data count unit 1009 counts the number of occurrences of consecutive count patterns predetermined for each nozzle block according to the count patterns that are set in a preliminary ejection setting unit 1008 and the analysis result of the command analysis unit 1003. A preliminary ejection control unit checks, for each block, if the count value has reached a predetermined value and, if the count value has reached the predetermined value in at least one block, starts preliminary ejection for the recording head.

12 Claims, 24 Drawing Sheets

FIG. 9A DECOMPRESSED DATA IS 01 (HEXADECIMAL)
BINARY (00000001)
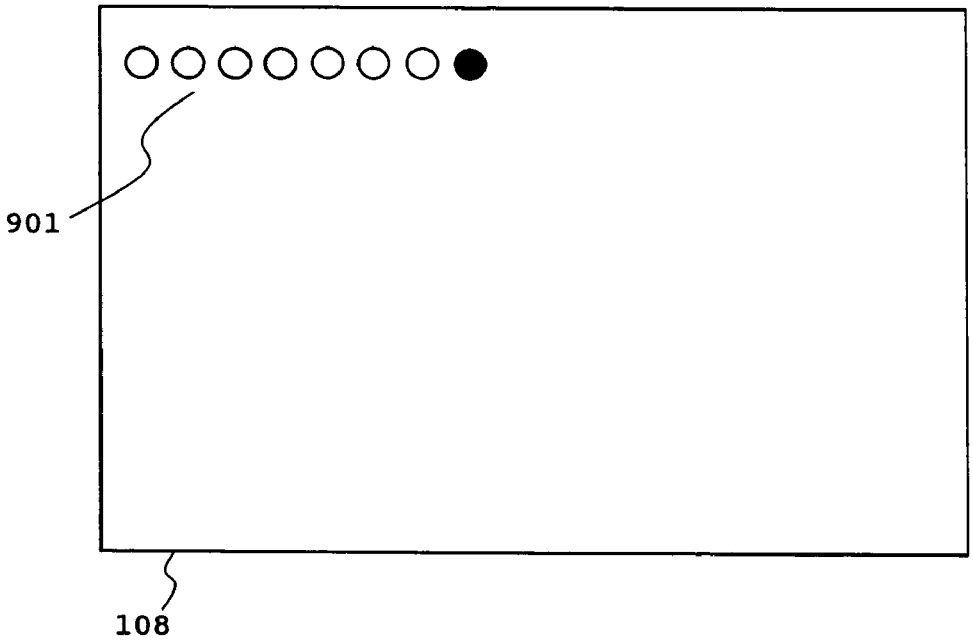
FIG. 9B DECOMPRESSED DATA IS 55 (HEXADECIMAL)
BINARY (01010101)
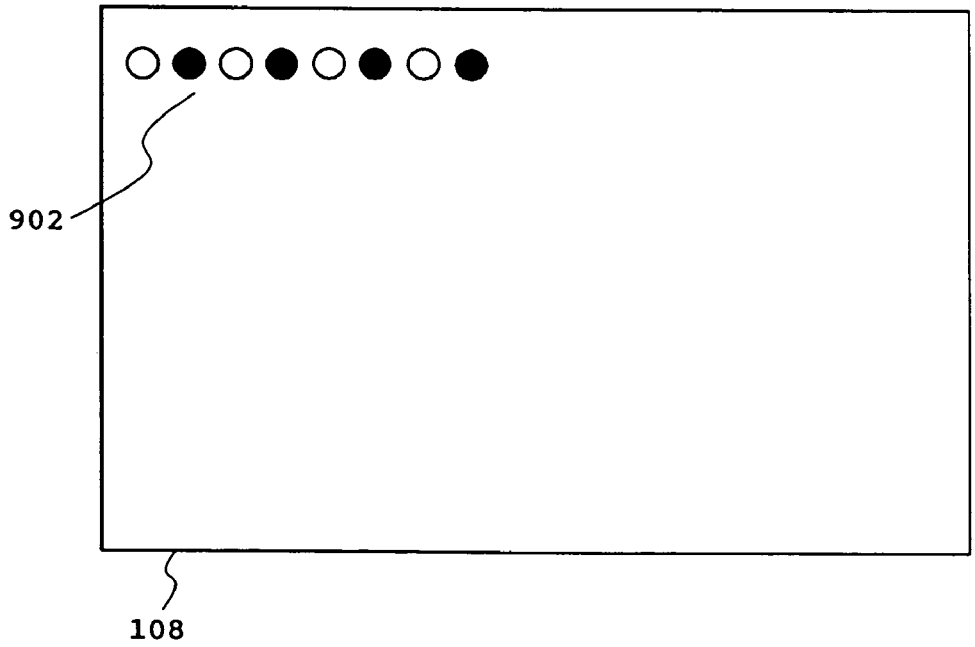

INKJET RECORDING DEVICE AND RECOVERY PROCESSING METHOD

DETAILED DESCRIPTION

1. Field of the Invention

The present invention relates to an inkjet—recording device that records an image using a recording head of the inkjet recording method and to a recovery processing method for performing the preliminary ejection operation to keep the ejection state of the recording head in good condition.

2. Related Art

In a conventional inkjet recording device that records an image using a recording head of the inkjet recording method, the nozzles through which ink is ejected from the recording head are exposed in the air. This structure results in the drying of ink or the adhesion of foreign particles to near the ejection nozzles, sometimes causing an ejection failure. To prevent this ejection failure, it is necessary to eject ink for recovery purposes though the ejection (preliminarily eject) that does not contribute directly to image printing.

To perform such recording head recovery processing, the maximum interval time during which ink is ejected normally is calculated for all line heads and, in many cases, the recovery processing is performed regularly at a predetermined time interval equal to or less than the maximum interval time. This recovery processing interrupts the recording regularly.

Another method for use in a conventional inkjet recording device is that the period of time during which no ink is ejected is calculated for each nozzle and, for a nozzle from which no ink is ejected for a predetermined time, ink is preliminarily ejected from that nozzle onto a recording medium. This preliminary ejection onto a recording medium is called "paper preliminary ejection" (see Examined Utility Model Publication No. Hei 3-45814).

A still another method for use in a conventional inkjet recording device is that, when ink is not ejected for a predetermined period, ink is preliminarily ejected in the margin part of a recording medium (see Japanese Patent Laid-Open Publication No. 2002-225301).

A still another method for a high-resolution recording head is proposed in which, when a predetermined time has elapsed, ink is preliminarily ejected in the recording area of a recording medium (see Japanese Patent Laid-Open Publication No. 2002-144599).

A still another method is proposed in which recovery processing is performed, not for the whole recording head, but selectively for a plurality of constituent head units (see Japanese Patent Laid-Open Publication No. Hei 8-127137).

However, the prior-art technologies described above have the following problems.

The technology in which recording processing is interrupted for performing recovery processing is not suitable for a recording device designed for high-speed recording because the recovery processing wastes time.

Preliminary ejection described in the technology disclosed in Examined Utility Model Publication No. Hei 3-45814, in which ink is ejected in the margin part of paper without interrupting the print operation, is not suitable for printing on a consecutive paper with no margin or a long recording size paper. In particular, in a conventional inkjet recording device using a long-type line head on which a plurality of recording elements are linearly arranged across the paper, the print operation is usually continued for a relatively long time when printing on a consecutive paper such as a roll paper. This consecutive print operation increases the viscosity of ink on the nozzles, from which ink is not ejected over a predetermined time, and tends to cause an ejection failure.

The methods disclosed in Japanese Patent Laid-Open Publication No. 2002-225301 and Japanese Patent Laid-Open Publication No. 2002-144599 also have a problem that, when a predetermined time has elapsed, ink is preliminarily ejected from all nozzles on the recording head regardless of the history of the recording operation, resulting in the waste of ink.

In particular, in a recording device with a line head that has much more nozzles than a serial head, preliminarily ejecting ink from the nozzles at the same frequency causes ink to be preliminarily ejected from all nozzles periodically regardless of an image to be printed. This preliminary ejection significantly increases the waste of ink.

Therefore, for high-speed, high-quality recording, it is necessary to reduce the number of unnecessary preliminary ejection and to reduce the number of preliminary ejection operations themselves.

SUMMARY OF THE INVENTION

In view of the foregoing, it is an object of the present invention to provide an inkjet recording device that preliminarily ejects ink, not at a predetermined interval of time but only at a time determined necessary for preliminary ejection, to reduce the number of preliminary ejection and wasteful preliminary ejection time, to increase the throughput, and to reduce the waste of ink.

It is another object of the present invention to provide an inkjet recording device that has an independent recovery feature for each recording head module of the recording device for selective recovery operation and that is capable of continued recording operation with other recording head modules depending upon the contents of an image.

An inkjet recording device according to the present invention comprises a recording head composed of a sequence of nozzles from which ink is ejected; and head control means for ejecting ink droplets from the sequence of nozzles of the recording head based on recording data and for controlling a preliminary ejection operation to keep an ink ejection state of the recording head in good condition, wherein the head control means comprises counting means that analyzes the recording data for counting a number of consecutive occurrences of a predetermined count pattern for each of nozzle blocks, the sequence of nozzles of the recording head being divided into the nozzle blocks each composed of a plurality of nozzles; and determination means for determining for each block if the count value of the counting means has reached a predetermined value wherein, if there is at least one block where the count value has reached the predetermined value, preliminary ejection processing is performed for the recording head.

The predetermined count pattern can be a pattern corresponding to a case in which ink is ejected from none of the nozzles of a nozzle block. The number of consecutive occurrences of such a count pattern is counted, and whether this count value has reached a predetermined value is checked to determine whether to perform preliminary ejection. That is, when the count has reached a predetermined value in at least one block, preliminary ejection processing is performed for the recording head.

In some cases, the count value of any block does not reach a predetermined value for a long time depending upon the recording data, in which case there is no need for preliminary ejection processing. That is, there is no need for regular preliminary ejection processing at a fixed time interval that is performed regardless of what recording data is.

When the recording data is compressed, the counting means detects the count pattern based on the decompression result when the compressed data is decompressed, thus avoiding waste in pattern determination and count processing.

Preliminary ejection processing performed at a preliminary ejection time determined by a search through the compressed data may be either paper preliminary ejection processing or preliminary ejection processing on a recovery unit.

A plurality of count patterns may be set and, in such a case, the counting means determines that the count pattern occurs "consecutively" even when different count patterns occur consecutively. When this pattern setting and the counting method are used, it is determined that preliminary ejection is required when ink is ejected from some nozzles of a nozzle block but no ink is ejected consecutively from some of the other nozzles. As a result, whether to perform preliminary ejection can be determined more accurately.

It is also possible that the control means changes the count pattern arbitrarily in response to an external instruction.

The control means can detect an end of one line based on a horizontal image size included in image size information associated with the recording data, or can detect an end of a page based on a vertical image size included in image size information associated with the recording data.

When a line skip command that is used to skip a recording of one whole line is detected and if a detected number of consecutive lines to be skipped is equal to or larger than a predetermined number, the control means performs preliminary ejection processing immediately. If a detected number of consecutive lines to be skipped is smaller than the predetermined number, the control means causes the number of lines to be reflected on a count value of each block. This makes it possible to determine whether to perform preliminary ejection when a skip command is found.

A recovery processing method for use in an inkjet recording device according to the present invention comprises the steps of analyzing the recording data and counting a number of consecutive occurrences of a predetermined count pattern for each nozzle block, the sequence of nozzles of the recording head being divided into a plurality of nozzle blocks each composed of a plurality of nozzles; determining for each block if the count value has reached a predetermined value; and if there is at least one block where the count value has reached the predetermined value, starting preliminary ejection processing for the recording head.

The inkjet recording device and the recovery processing method for the inkjet recording device according to the present invention detect a count pattern for the nozzle blocks which are generated by dividing a sequence of nozzles, count the number of consecutive occurrences of the count pattern and, based on this count value, determine whether to perform preliminary ejection for the recording head. Therefore, the inkjet recording device can preliminarily eject ink not at an interval of fixed time but only at a required time. As a result, this method reduces the number of preliminary ejection operations, increases the recording speed, and reduces a waste of ink. In addition, when paper preliminary ejection is performed as the preliminary ejection, this method reduces unnecessary paper preliminary ejection and therefore increases the quality of a recording image.

Another advantage is that the inkjet recording device according to the present invention checks the contents of recording data, not on a dot basis, but on a nozzle block basis, thus making it possible to quickly determine whether to perform preliminary ejection. The inkjet recording device requires fewer counters and, thus, employs simplified hardware and software configurations.

When received recording data is compressed, the count pattern can be detected when the compressed data is decompressed. This avoids waste of processing and makes it possible to quickly determine whether to perform preliminary ejection.

The ability of the user to set any count pattern allows the user to select a preliminary ejection method best suited to his or her usage with the types and characteristics of recording images in mind.

In another aspect of the present invention, there is provided an inkjet recording device comprising a plurality of recording heads each formed by a sequence of nozzles from which ink is ejected; and a plurality of recovery means provided for the plurality of recording heads, one for each, to keep an ink ejection state of the plurality of recording heads in good condition wherein each of the plurality of recovery means operates independently of other recovery means.

This configuration can reduce the excessive recovery processing of the recording head, resulting in a reduction in the waste of time during the recording operation. This configuration can also reduce the amount of ink wastefully used for the recovery operation.

DESCRIPTION OF THE DRAWINGS

FIG. 9A and FIG. 9B are diagrams showing how data is represented after compressed data is decompressed;

PREFERRED EMBODIMENTS OF THE INVENTION

Preferred embodiments the present invention will be described in detail below with reference to the drawings.

First Embodiment

Figure 1:
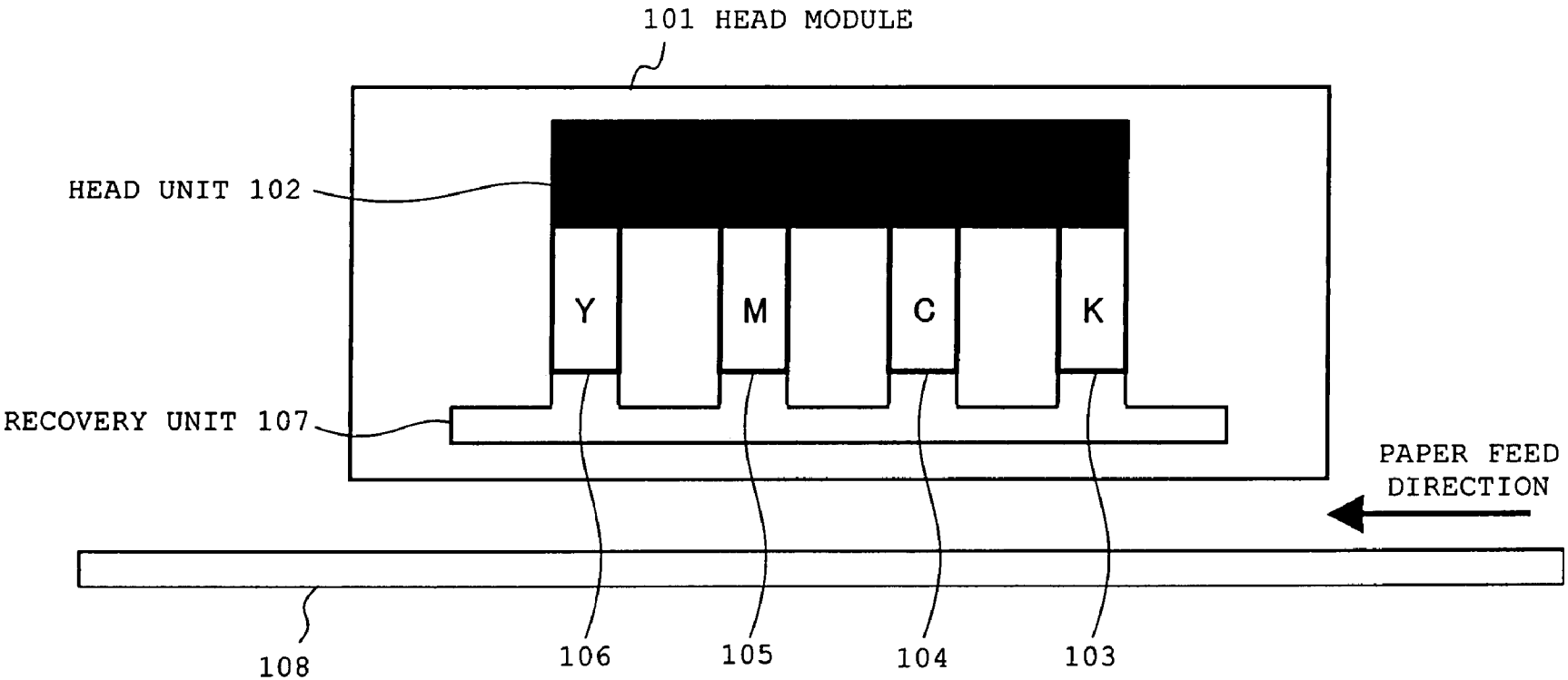
FIG. 1 is a diagram showing the configuration of an inkjet recording device with four line heads, which are long-type recording heads each composed of a plurality of recording elements arranged linearly across the width of a paper, in a first embodiment of the present invention.

FIG. 1 shows a diagram showing the configuration of an inkjet recording device using four lines heads, each of which is a long-type recording head, where a plurality of recording elements are arranged linearly across the width of a paper.

Line heads 103-106, each 4 inches in the recording width (length in the paper width direction), are fixed in order of K (black), C (Cyan), M (Magenta), and Y (Yellow) in a head module 101 as a head unit 102. FIG. 1 shows the state in which the heads are placed on a recovery unit 107. The line heads are in this state (capping state) during the non-recording time (standby time) or the head recovery processing time.

Figure 2:
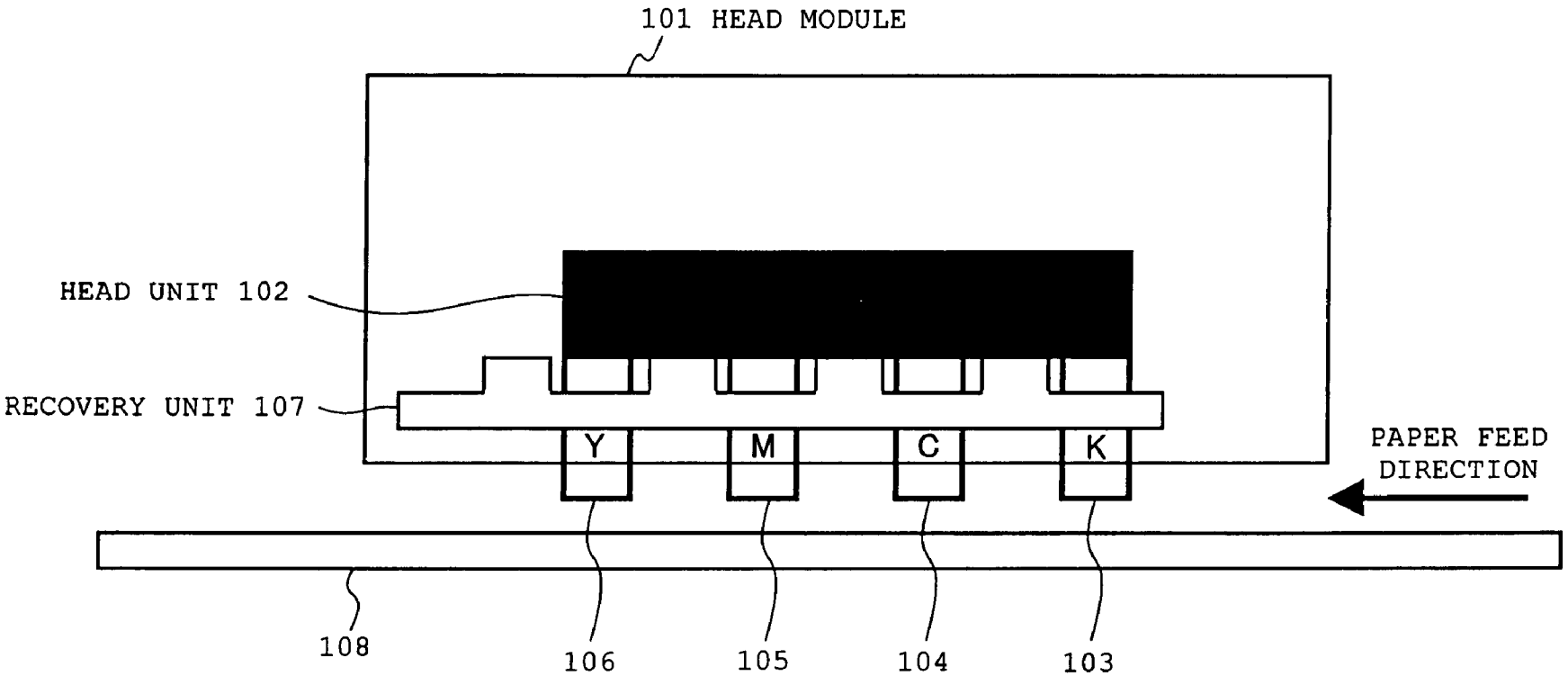
FIG. 2 is a diagram showing a state in which the head module shown in FIG. 1 is in recording operation.

A paper 108 is fed under the head module 101 into the direction shown in the figure. FIG. 1 shows an example in which a consecutive paper is used. FIG. 2 is a diagram showing the state in which the head module 101 is in recording operation.

Before the recording operation is started, the recovery unit 107 first moves into the paper feed direction and the head unit 102 moves downward (into paper surface direction) near to the paper 108 through the holes in the recovery unit. Then, recording (ink ejection) is started in the state shown in FIG. 2. After the recording is finished, the head unit 102 moves in the reverse order until it returns to the state shown in FIG. 1 and enters the storage state or the head recoverable state with the line heads on the recovery unit 107.

To keep good ejection performance of the inkjet head, the following operations must be performed: the pressurization, circulation, and recovery operation in which ink in the head is pressurized, circulated, and recovered under a predetermined condition; the preliminary ejection recovery operation in which ink is preliminarily ejected before starting the recording; and the cleaning operation in which a wiper blade, installed on the recovery unit 107 but not shown, wipes the nozzle faces.

When the head module is not in the recording operation and the heads leave the capping state with nozzles exposed in the air, an ejection failure is sometimes caused by dried ink or foreign particles on the ejection nozzles. To prevent this ejection failure, it is necessary to eject (preliminarily eject) ink for recovery purposes though the ejection that does not contribute directly to image printing. There are two types of preliminary ejection: one type is preliminary ejection in which ink is preliminarily ejected in the capping state shown in FIG. 1 and the other type is paper preliminary ejection in which ink is preliminarily ejected on paper inconspicuously regardless of data to be recorded during recording.

Figure 3:
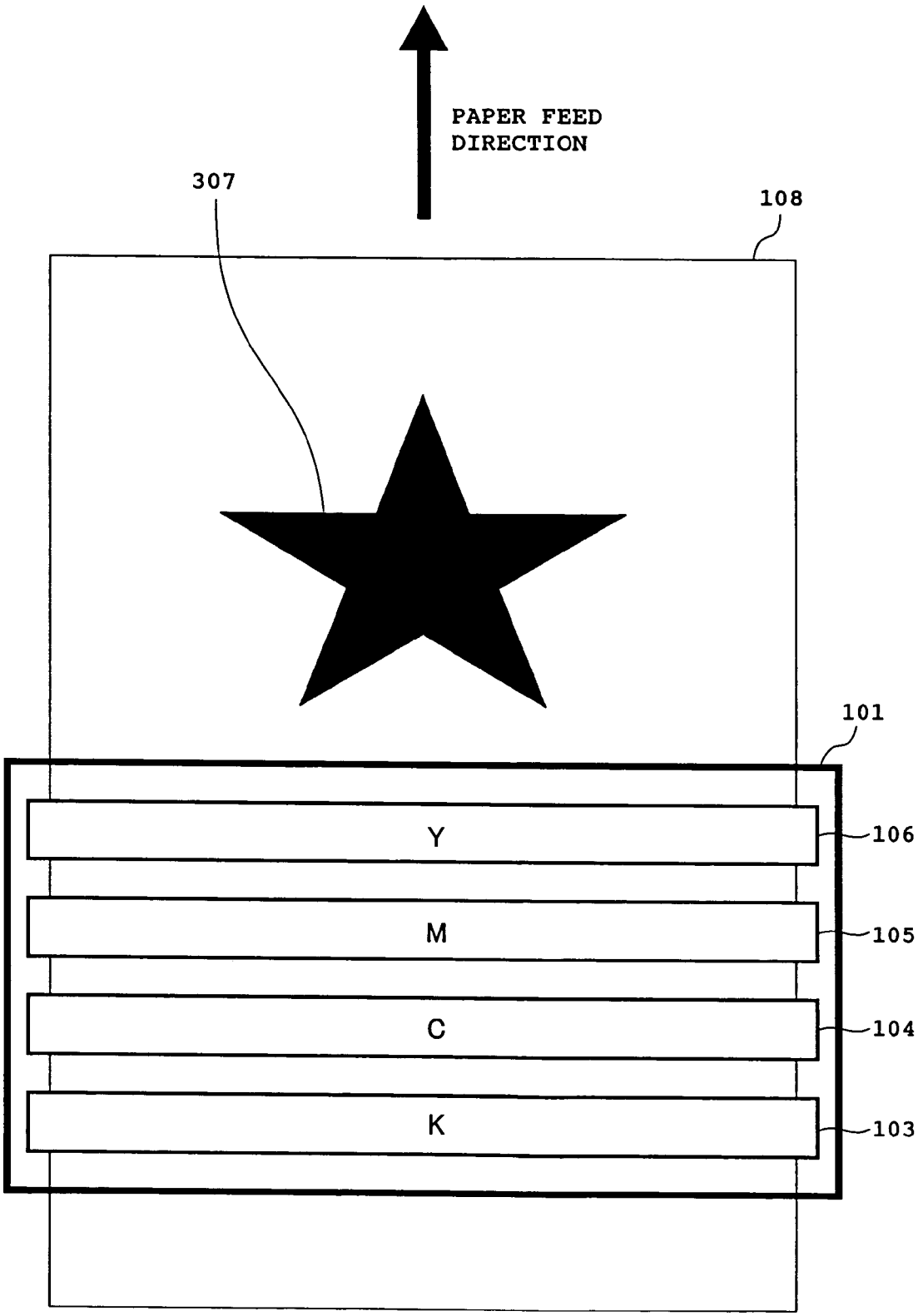
FIG. 3 is a diagram showing how an image is recorded using the head module shown in FIG. 1.

FIG. 3 is a diagram showing how an image is recorded on the wide paper 108 with the head module 101 in FIG. 1 arranged as shown. In this embodiment, the 4-inch line heads are arranged in parallel to record an image of the maximum of about 4 inches. The figure shows a graphic 307 recorded on the 4-inch-wide paper 108 using the 4-inch line heads 103-106.

Figure 4:
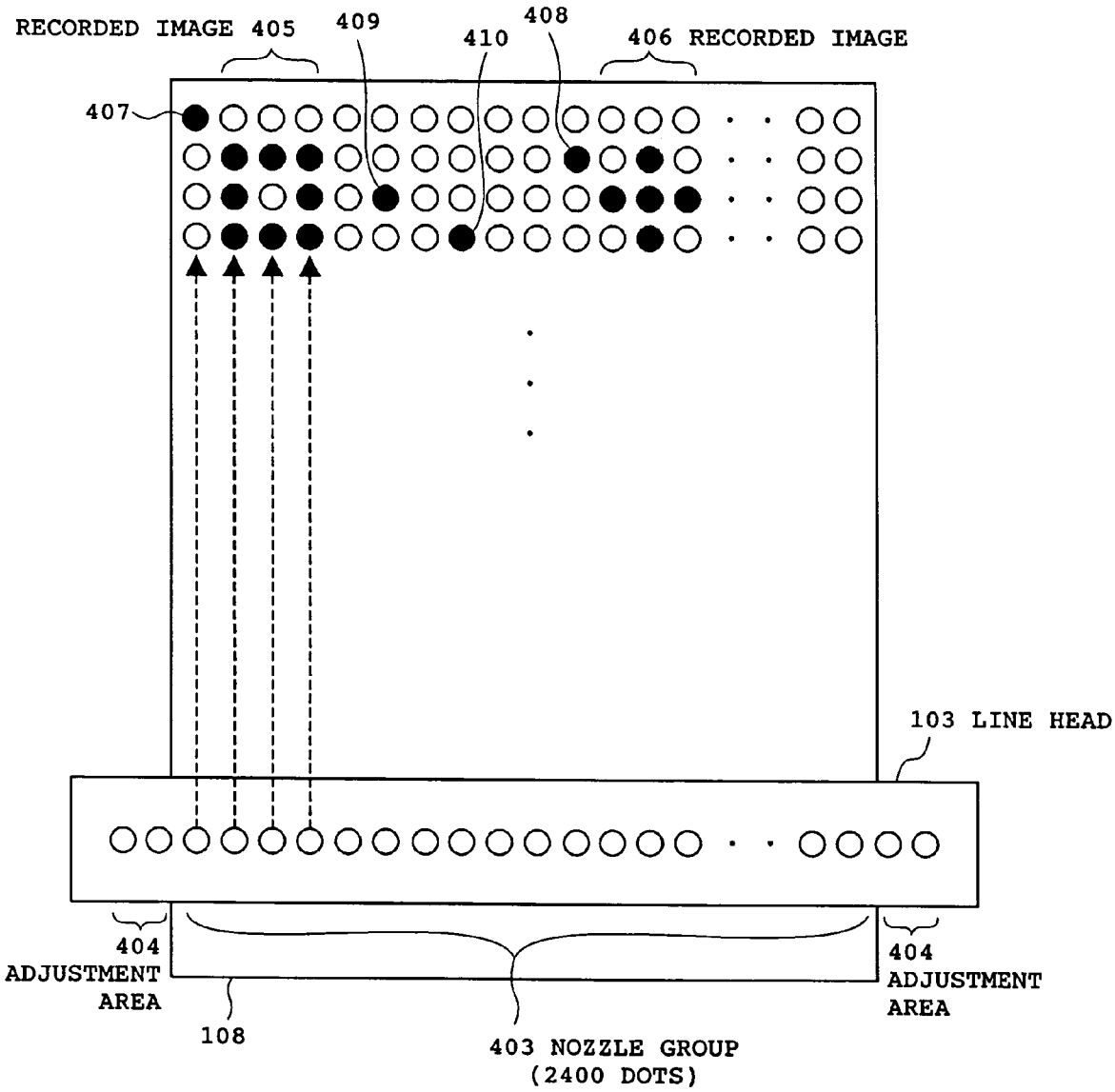
FIG. 4 is a diagram showing an actual example of nozzle arrangement and paper preliminary ejection in the first embodiment of the present invention.

FIG. 4 shows an example of paper preliminary ejection in which the line head 103 records an image on the paper 108. The number of nozzles (dots) of a nozzle group 403 of the line head 103 corresponding to the paper size is 2400 dots. The line head 103, whose head position is fixed relative to the paper, has adjustment areas 404, one on each end of the nozzle group 403, for electrically adjusting (correcting) a misalignment in the relative width-direction installation position (horizontal registration) relative to the other heads not shown. Although only 2 dots are provided on each of the left and right sides as the adjustment area 404 in FIG. 4, it is preferable to provide the number of nozzles considering the adjustment area (for example, 16 dots on each of the right and left sides).

In recorded images 405 and 406, the black dot part indicates that ink is ejected from the nozzles of the line head 103 based on recorded data while the white dot part indicates that no ink is ejected, that is, spaces in the recorded image. In normal printing, the space part composed of white dots and the recorded part composed of black dots form a recorded image.

Apart from the recorded image described above, dots 407-410 are dots recorded according to an ejection pattern of paper preliminary ejection. The ejection positions are dispersed to make the dots inconspicuous for the purpose of paper preliminary ejection. Although those preliminarily ejected dots of ink sometimes overlap with a recorded image (405 and 406 in this example), it is desirable that preliminarily ejected dots of ink not be generated in the areas of the recorded images 405 and 406 because preliminarily ejected dots of ink are not necessary in those areas.

To prevent the paper preliminary ejection pattern, which tends to become regular, from being conspicuous, it is also possible to preliminarily eject ink randomly for each line on each page. Random preliminary ejection sometimes generates dots of ink that overlap with a recorded image (405 and 406 in this example). It is also possible to form a preliminary ejection pattern randomly while preventing preliminarily ejected dots of ink from overlapping with the recorded image 405 and 406.

Figure 5A:
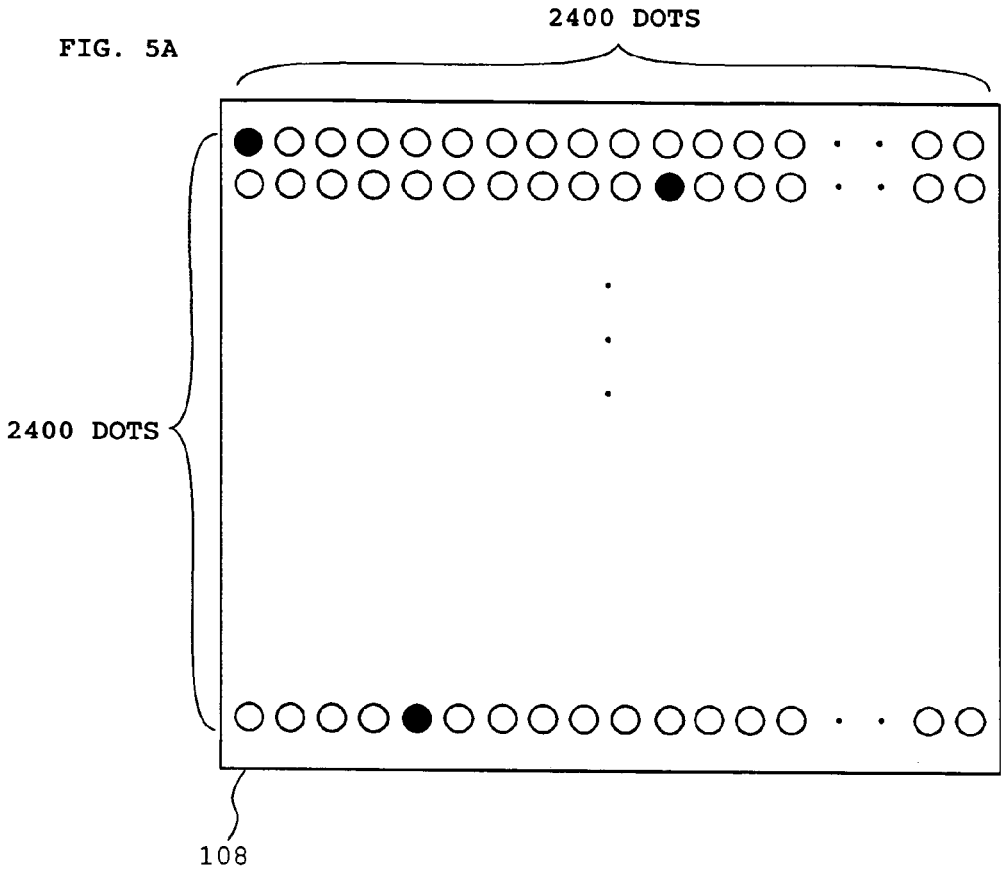
FIG. 5A and FIG. 5B is diagrams showing two examples of paper preliminary ejection patters.
Figure 5B:
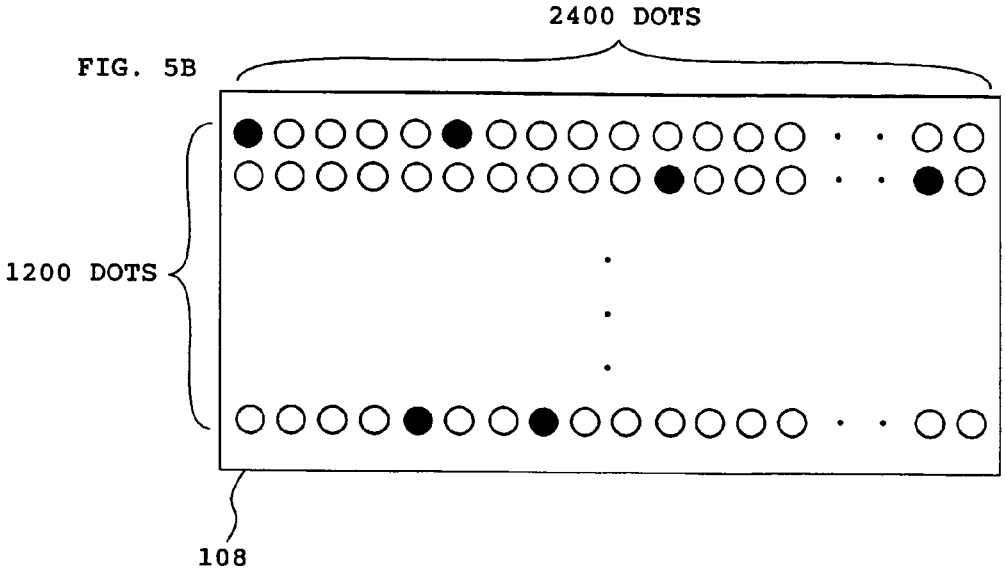

FIG. 5A and FIG. 5B show two examples of a paper preliminary ejection pattern. As in the example in FIG. 4, a paper preliminary ejection pattern shown in FIG. 5A is an example of a preliminary ejection pattern in which only one dot of ink is preliminarily ejected on one line. Preliminarily ejecting one dot of ink on one line means that the preliminary ejection for the 2400 effective dots of the line head 103 requires 2400 lines.

A paper preliminary ejection pattern shown in FIG. 5B is an example of a preliminary ejection pattern in which two dots of ink is preliminarily ejected on one line. Preliminarily ejecting two dots of ink on one line means that the preliminary ejection for the 2400 effective dots of the line head 103 requires 1200 lines. That is, though the range of a sequence of the preliminary ejection range can be reduced, the dots recorded by the preliminary ejection can be close to each other. There can be a preliminary ejection pattern, though not shown, composed of one dot per a plurality of lines.

Figure 6:
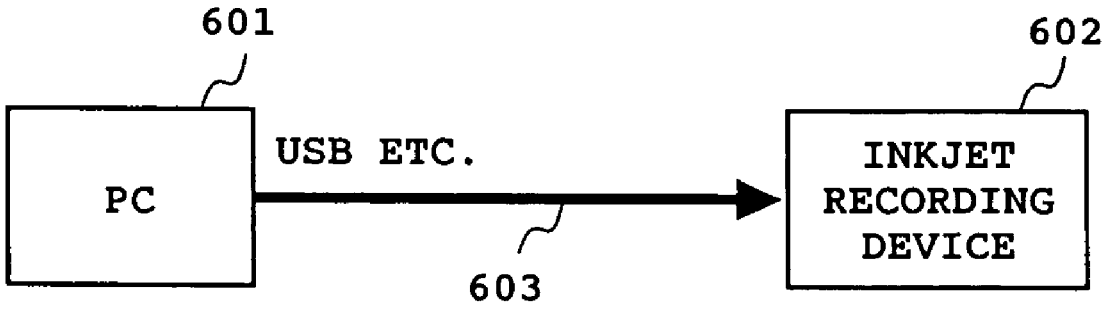
FIG. 6 is a diagram showing the relation of connection between a personal computer (PC) and the inkjet recording device.

FIG. 6 is a diagram showing the connection relation between a personal computer (PC) 601 and an inkjet recording device 602. Recording data generated by the software in the PC 601 is compressed according to the compression method that will be described later and is sent to the inkjet recording device 602 via a communication interface such as a USB interface 603.

Figure 7:
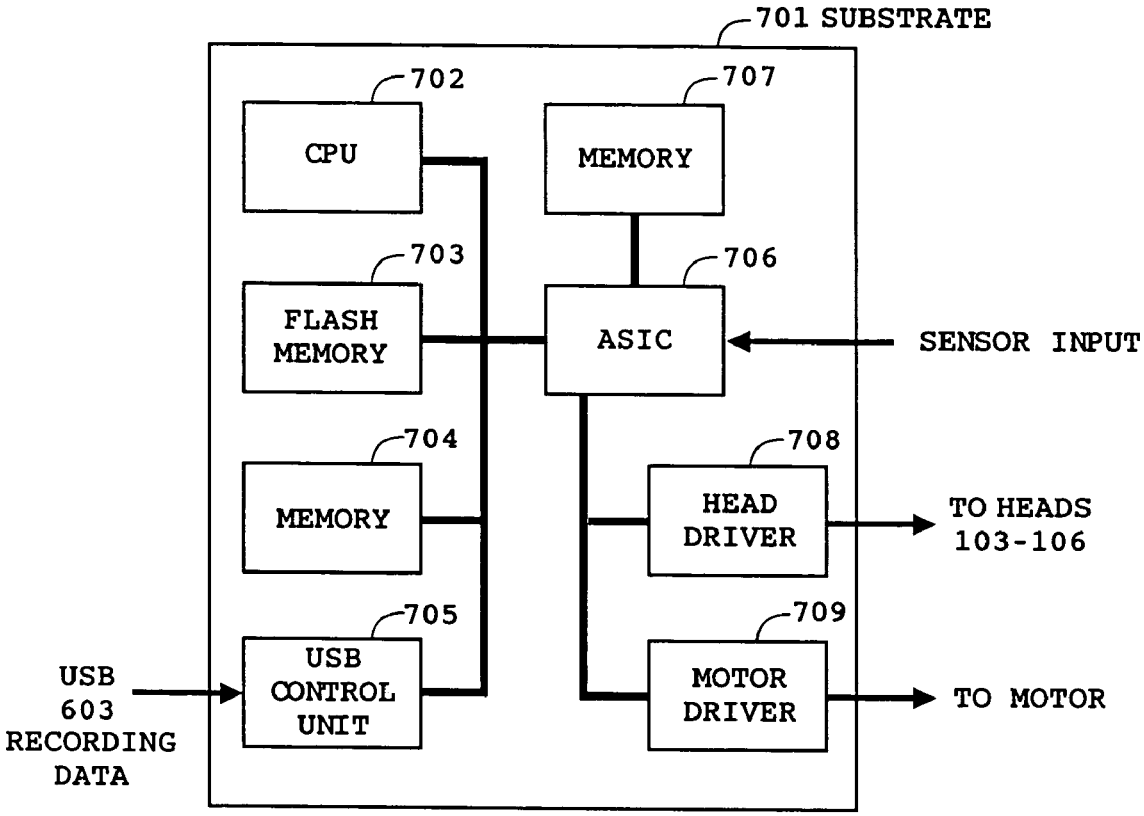
FIG. 7 is a diagram showing the configuration of a substrate that controls the head module shown in FIG. 1.

FIG. 7 is a diagram showing the configuration of a substrate 701 that controls the head module 101. A CPU 702 where a program stored in a flash memory 703 runs once expands compressed recording data, which is received from the PC 601 via a USB control unit 705, into a memory 704 for processing and transfers the compressed data to an ASIC (Application Specific Integrated Circuit) 706. The ASIC 706 uses a recording data memory (VRAM) 707, connected thereto, to decompress the compressed data and saves the decompressed data. At the same time, the ASIC 706 sends recording data to a head driver 708 for recording while counting the number of count patterns. According to the present invention, this count value is used to determine whether to preliminarily eject ink. At a recording time, the status of a motor, a feeding encoder (not shown), and a paper detection sensor (not shown) is checked and, based on the status, a motor driver 709 is controlled to integrally control the head unit 102 and the recovery unit 107 for recording an image.

Data transmitted from the PC 601 to the inkjet recording device 602 is usually compressed for faster data communication and recording. One of compression methods used for this purpose is a PackBits compression method. The PackBits compression method compresses data as follows.

Consecutive same data are represented by the following two bytes.

Number of consecutive bytes+Consecutive data

The command representing the number of consecutive bytes is FF (hexadecimal) when there are two consecutive bytes and is 81 (hexadecimal) when there are 128 consecutive bytes. Therefore, the number of consecutive data pieces is represented by one of FF to 81. For example, three consecutive bytes of 00 (hexadecimal) (that is, "00 00 00") are represented by "FE 00".

Nonconsecutive data are represented as follows.

Number of nonconsecutive bytes+Nonconsecutive data

The command representing the number of nonconsecutive bytes is 00 (hexadecimal) when there is one nonconsecutive byte and is 7F (hexadecimal) when there are 128 nonconsecutive bytes. Therefore, the number of nonconsecutive data pieces is represented by one of 00 to 7F.

For example, 01 02 03 (hexadecimal) are represented by 02 01 02 03.

Data sent to the head module 101 is compressed by the printer driver in the PC 601 using the method described above.

Figure 8:
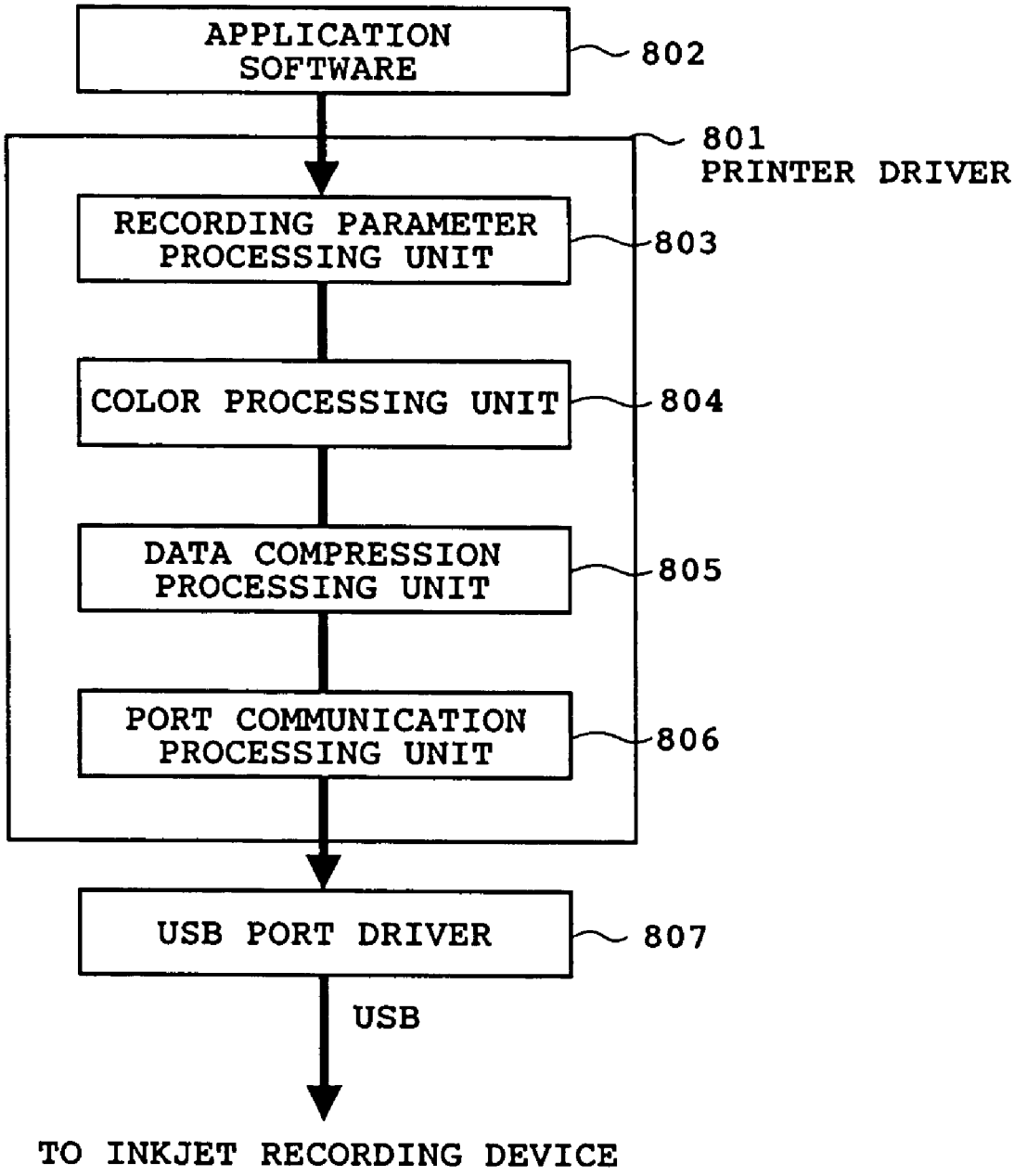
FIG. 8 is a diagram showing the configuration of a printer driver in the first embodiment of the present invention.

FIG. 8 is a diagram showing the configuration of the printer driver. An image created by the user using application software 802 is sent to a printer driver 801 as recording data when the user executes recording processing.

First, a recording parameter processing unit 803 obtains information, such as the paper size or the recording image size, from image data received from the application software 802 and converts the information to a command so that the head module 101 can process it.

Next, a color processing unit 804 processes the color of the converted image data (for example, RGB->CMYK->binarization). Then, a data compression processing unit 805 uses the method described above to compress the recording data for which color processing has been performed. In this embodiment, compressed data is sent to a port communication processing unit 806 that controls port communication with a USB port driver 807 called a language monitor or a port monitor, and then the compressed data is sent to the head module 101 via the USB interface 603.

As described above, data compressed in the PC 601 is sent to the head module 101. This configuration reduces the amount of data transferred via the USB interface 603 between the PC 601 and the head module 101, thus increasing the substantial data transfer rate and resulting in speedy recording processing.

With reference to FIGS. 9A and 9B, the following describes how data once compressed by the print driver as described above is decompressed. The recording data is binarized by the color processing unit 804 of the printer driver binarization means that whether to eject ink from a nozzle of a line head is represented by a binary value. Therefore, when the decompressed data is 01 (hexadecimal) as shown in FIG. 9A, the binary equivalent is "00000001" that is a recording pattern 901. Similarly, when the data is 55 (hexadecimal) as shown in FIG. 9B, the binary equivalent is "01010101" that is a recording pattern 902.

Data compressed according to the PackBits compression method as described above is processed eight bits (one byte) at a time.

Figure 10:
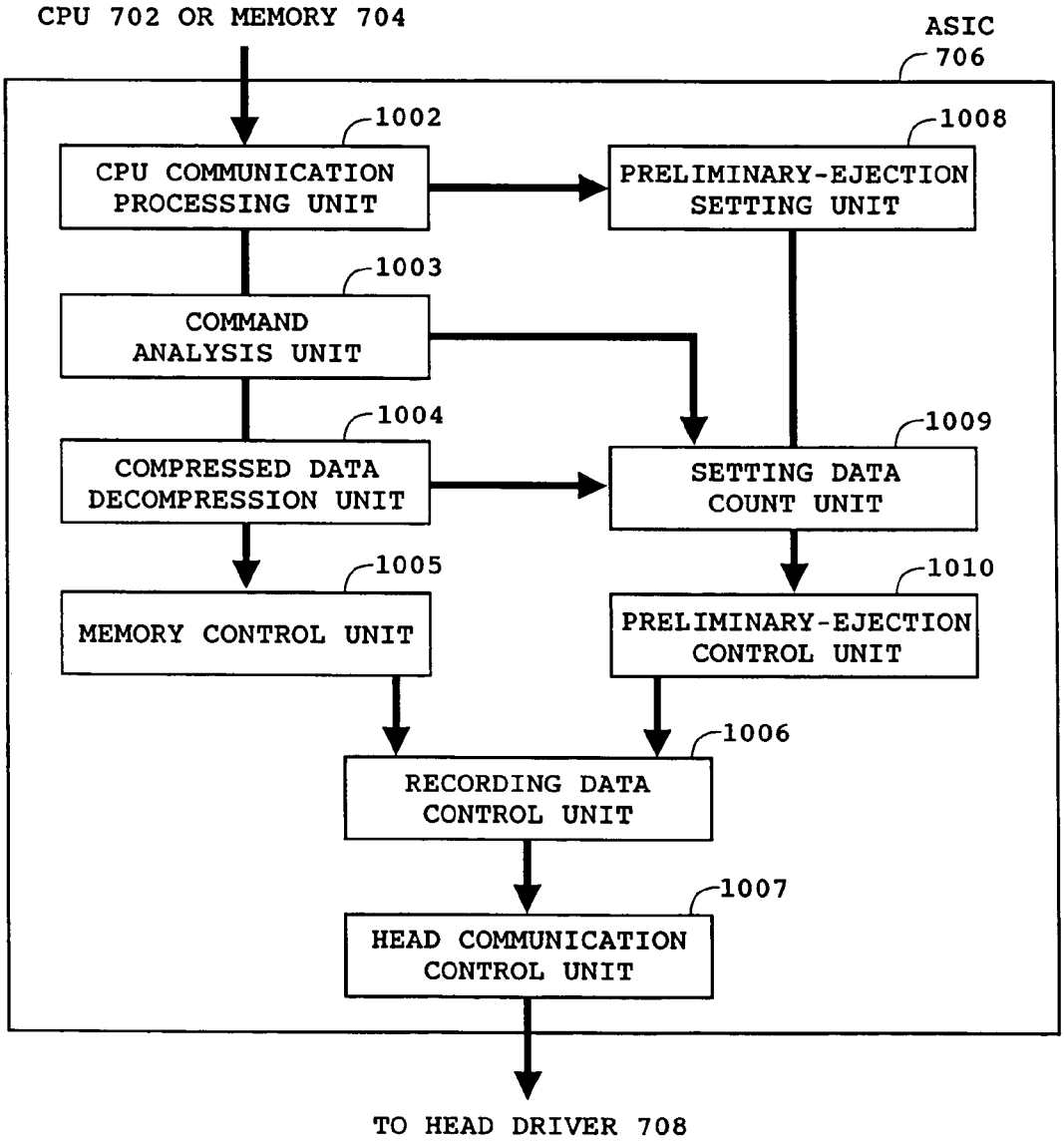
FIG. 10 is a diagram showing the internal configuration of an ASIC installed on the control substrate shown in FIG. 7.

FIG. 10 is a diagram showing the internal configuration of the ASIC 706 installed on the control substrate of the head module 101. The ASIC 706 shown in FIG. 10 receives compressed data, stored in the memory 704, under control of the CPU 702 and processes the received data. The ASIC 706 is set up also by the CPU 702. A CPU communication processing unit 1002 transfers the settings of the ASIC 706 to the modules of the ASIC 706 such as a preliminary ejection setting unit 1008. FIG. 10 mainly shows the data flow, not the connection among the modules, and shows that the setting data from the setting units is set in the corresponding modules. The following describes the detail.

Figure 11:
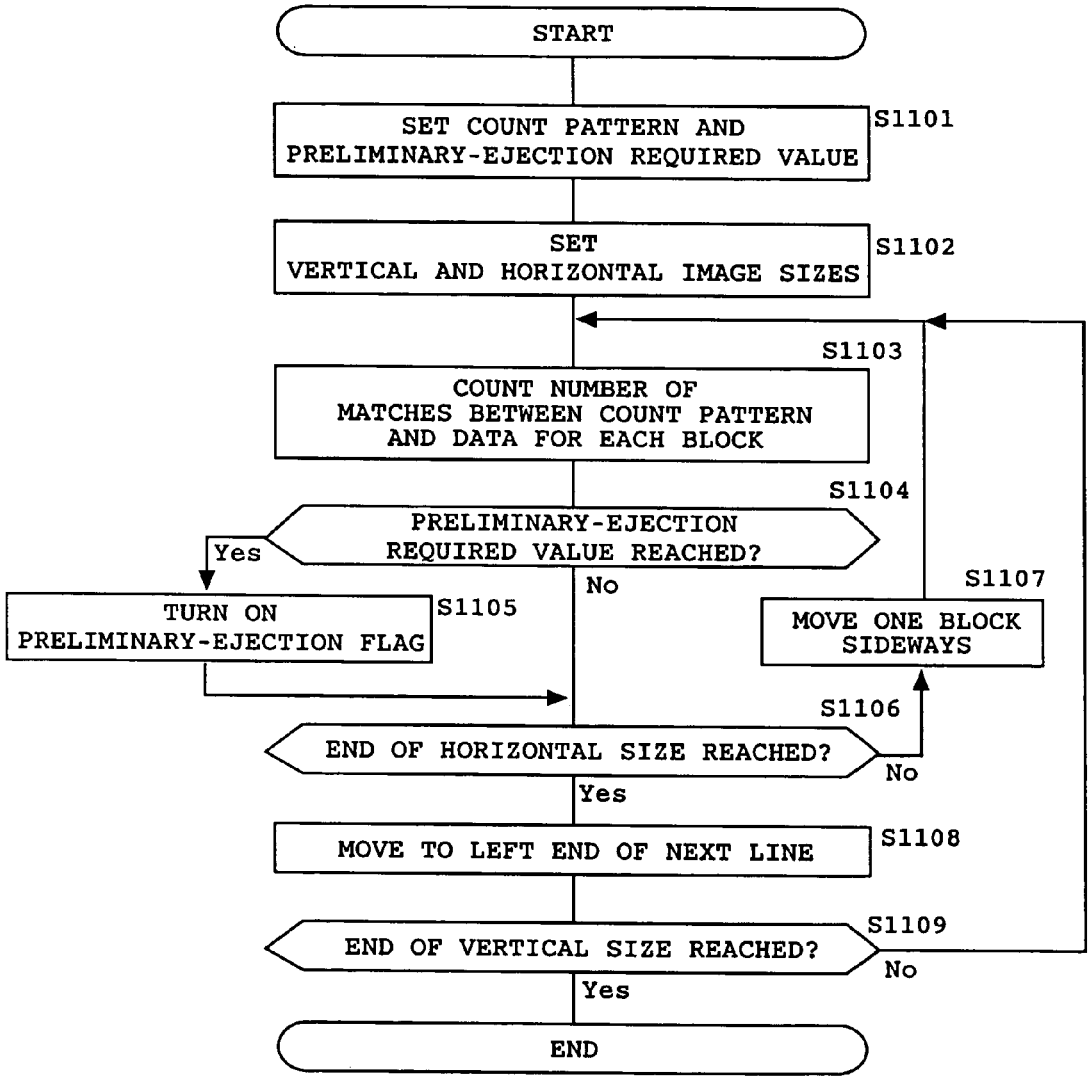
FIG. 11 is a flowchart showing the control method executed by the ASIC installed on the control substrate shown in FIG. 7.

FIG. 11 is a flowchart showing the control method of the ASIC 706 installed on the control substrate of the head module 101 in this embodiment. The program containing the execution steps of this flowchart is stored in the memory (703 or 704), and the CPU 702 interprets and executes the steps to execute the processing. The steps of other flowcharts are processed in the same manner.

Figure 12:
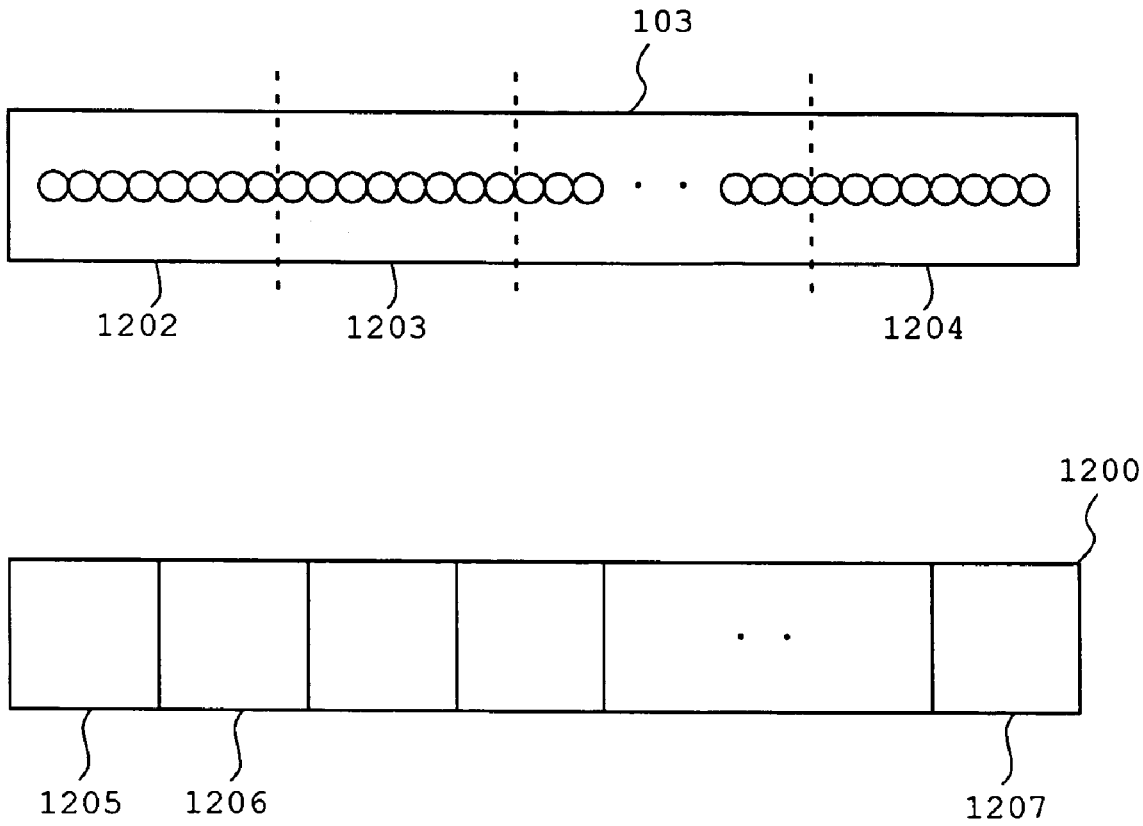
FIG. 12 is a diagram showing how the setting data count unit shown in FIG. 10 counts the number of count patterns.

Before describing the flowchart, the following describes, with reference to FIG. 12, how a setting data count unit 1009 counts the number of count patterns for determining whether preliminary ejection is required. Because data is compressed on a one-byte basis as shown in FIG. 9, blocks 1202-1204 of the line head 103 are divided into eight-nozzle units. The setting data count unit 1009 compares the one-byte data, which corresponds to eight nozzles, with a value that is set in the preliminary ejection setting unit 1008 by the CPU 702. If they match, the setting data count unit 1009 updates the value of a register 1200 (used as a counter in this case) composed of bits 1205-1207. The register 1200 is prepared for each eight nozzles (one byte). The number of bits of the register 1200 must be the large enough for counting the maximum count value.

The setting value that is set in the preliminary ejection setting unit 1008 is as follows. The decompressed data 00 (hexadecimal) is "00000000", meaning that no ink is ejected from the eight nozzles. For example, if 00 appears consecutively in the block 1202, eight nozzles of blanks appear consecutively in the vertical direction. If this condition occurs a predetermined number of times consecutively, preliminary ejection becomes necessary.

If the preliminary ejection setting unit 1008 is set up to count the number of count patterns only when the decompressed data is 00 as described above, preliminary ejection is executed when the count value of 00's reaches a preliminary ejection required value that is also set in the preliminary ejection setting unit 1008. The "preliminary ejection required value", which is a count value indicating that preliminary ejection is required when the number of consecutive count patterns reaches this count, is determined by the exposure time of nozzles on the line head. More specifically, the preliminary ejection required value is calculated by the expression given below. The calculated value is set in the preliminary ejection setting unit 1008 as the preliminary ejection required value.

Preliminary ejection required value=Feed speed of paper 108[inches/sec]×Exposure permissible time [sec]×Vertical resolution [dots/inch]=Total Number of dots For decompressed data 01 (hexadecimal) that is "00000001" or 80 (hexadecimal) that is "10000000", ink is ejected only from one nozzle but not from most nozzles of one block. Therefore, not only 00 (hexadecimal) but also other 8-bit patterns (01, 80, 10, 11, and 88) or other 8-bit patterns including a 4-bit pattern (1, 8 (hexadecimal)) can be set in the preliminary ejection setting unit 1008 as the count pattern for determining more accurately whether preliminary ejection is required.

In addition, a value such as 05, that is, "00000101", can also be set in the preliminary ejection setting unit 1008 to increase the accuracy. However, too many count patterns, if set, would not only decrease the processing speed of the setting data count unit 1009 and but take long before actual preliminary ejection processing. Therefore, it is not preferable to set more values than are necessary.

In the configuration example described above, the setting data count unit 1009 increments the count if the data matches the count pattern that is set (match condition). Instead, the setting data count unit 1009 may also increment the count if the data is not FF (11111111) or F (1111) (negation condition). Those values can also be count patterns.

With reference to FIG. 11, the following describes in detail the processing of the modules, that is, a command analysis unit 1003, a compressed data decompression unit 1004, and the setting data count unit 1009 shown in FIG. 10.

First, the CPU 702 sets the preliminary ejection required value and the preliminary ejection count pattern, which are described above, in the preliminary ejection setting unit 1008 via the CPU communication processing unit 1002 (S1101). At the same time, the CPU 702 also sets the paper preliminary ejection pattern type shown in FIG. 5. The preliminary ejection required value and the preliminary ejection count pattern that are set will be used by the setting data count unit 1009, and the paper preliminary ejection pattern type that is set will be used by a preliminary ejection control unit 1010.

Compressed data sent from the PC 601 is once stored in the memory 704 via the CPU 702. The stored compressed data is sent to the command analysis unit 1003 via the CPU communication processing unit 1002 under control of the CPU 702. The command analysis unit 1003 analyzes commands such as the image vertical and horizontal sizes and data colors, and sets the image vertical and horizontal sizes in the setting data count unit 1009 (S1102).

Because compressed recording data of each color is sent from the PC, the command analysis unit 1003 analyzes the color code and performs the following processing for each of the line heads 103-106.

The compressed image data, which was analyzed by the command analysis unit 1003 and from which unnecessary commands were removed, is sent to the compressed data decompression unit 1004. Upon receiving the compressed image data, the compressed data decompression unit 1004 analyzes the data compressed according to the PackBits method described above. To do so, the compressed data analysis module in the compressed data decompression unit 1004 once reads the compressed data to analyze the command representing the number of consecutive/nonconsecutive bytes in-the compressed data. In this case, the compressed data analysis module can check the command representing the number of consecutive/nonconsecutive bytes as well as the contents of data to be decompressed. At this time, the compressed data analysis module sends the data value to the setting data count unit 1009 that compares the count pattern, specified in step S1101 to determine whether preliminary ejection is required, with the block data and counts the number of time a match occurs for each block (that is, the number of occurrences of preliminary ejection count pattern) (S1103). More specifically, the setting data count unit 1009 counts the number of consecutive occurrences of the count pattern for the block. Each time the consecutive occurrence ends, the count value is reset.

Therefore, when recording data that is distributed almost all over the recording area continues (e.g., photograph without margin or poster), the counter is reset frequently and so preliminary ejection is not executed.

Note that, if multiple but different count patterns are set and they are consecutive, they are assumed to be "consecutive". In this case, it is also possible to provide multiple counters, one for each count pattern or one for each count pattern set, to count them separately.

Next, the setting data count unit 1009 checks if the count value has reached the preliminary ejection required value that was set in step S1101 (S1104). If the count value has reached the preliminary ejection required value, the setting data count unit 1009 turns on the preliminary ejection flag and requests the preliminary ejection control unit 1010 to execute preliminary ejection (S1105). The paper preliminary ejection pattern type is used by the preliminary ejection control unit 1010. In response to the request issued in step S1105, the preliminary ejection control unit 1010 executes preliminary ejection, in which ink is ejected at least once from every nozzle of the line head, according to the preliminary ejection pattern type. This preliminary ejection maybe intensive preliminary ejection on the recovery unit 107 or paper preliminary ejection distributed across the paper.

In the above description, the setting data count unit 1009 increments the count value of blocks and checks if the count value becomes equal to the preliminary ejection required value. Instead of this, the setting data count unit 1009 may also decrement the preliminary ejection required value, and if the preliminary ejection required value reaches 0, turn on the preliminary ejection flag.

The setting data count unit 1009 returns control to step S1103 to repeatedly count the count patterns of each block while moving sideways one block at a time (S1107) until the maximum horizontal size of one line is reached (S1106). When the maximum horizontal size of one line is reached and processing for the line has finished, the processing proceeds to the left end of the next line (S1108) and control is returned to step 1103. Those steps are repeated until the maximum vertical size is reached (S1109). This method can be used to process even recording data that has no explicit line delimiter or page delimiter.

When the above processing is repeated and the vertical size of the image is reached, the processing is terminated.

The values counted up to this time may also be stored unchanged in the memory 707 connected to the ASIC via a memory control unit 1005 as necessary. For continued recording beginning with page two, values are added to the stored values.

For a line head from which ink is preliminarily ejected, the count values of all blocks are reset. Because there is time before recording on page two and the following pages, the recording device waits in the state shown in FIG. 1 and preliminary ejection and recovery are performed for the recording device during the wait state. Again, in that case, all count values are reset and counting begins with 0 when the next recording is restarted.

The data decompressed and analyzed by the compressed data decompression unit 1004 as described above is once stored in the memory 707, connected to the ASIC, via the memory control unit 1005. After that, in synchronization with the driving period of the line head at recording time, the stored data is sent to a head communication control unit 1007 via the memory control unit 1005 under control of a recording data control unit 1006. At this time, if paper preliminary ejection pattern is used, the setting data count unit 1009 notifies the preliminary ejection flag (ON) and, if preliminary ejection is required, the preliminary ejection control unit sends the preliminary ejection pattern that was set in step S1101. This preliminary ejection pattern is combined with the decompressed image data in the recording data control unit 1006 and is sent to the head communication control unit 1007 and then to the line heads 103-106 via the head driver 708 for recording. Although only one line head is described in the example given above, the same processing is executed for each of line heads 103-106.

Although the PackBits compression method is used and preliminary ejection is counted by dividing an image into units of one byte in this embodiment, the preliminary ejection can also be accomplished by using other compression methods to divide an image into units of several bytes.

In the example of the inkjet recording device in this embodiment, the four line heads are used, one color for each. It is also possible to increase the number of colors on four or more line heads each of which has a preliminary ejection counter. Similarly, this embodiment may also be applied to three or less line heads.

As described above, the inkjet recording device in the first embodiment counts the number of count patterns to determine whether to execute preliminary ejection when the recording data is still in the compressed form. This eliminates the need for detecting recording data in a dot-by-dot manner, thus speedily determining whether to execute preliminary ejection. Another advantage is that the inkjet recording device counts, not nozzles, but blocks each composed of multiple nozzles, thus requiring less counters (registers). This reduces the size of the ASIC where counters are provided. In addition, because a count pattern is detected for each compressed data unit and the count pattern can be compared with the data when the compressed data is decompressed, whether they match can be detected speedily without wasteful processing.

The ability to determine whether to perform preliminary ejection based on the count value of a count pattern eliminates the need for regular preliminary ejection at a predetermined interval. This method detects nozzles from which ink is not actually ejected and causes ink to be preliminarily ejected only from those nozzles for which preliminary ejection is needed. Thus, the inkjet recording device in this embodiment reduces unnecessary paper preliminary ejection or preliminary ejection, increases the recording image quality, increases the recording speed, and reduces the waste of ink.

The inkjet recording device allows the user to set any recording data detection threshold (that is, a preliminary ejection required value) for preliminary ejection and therefore allows the user to perform preliminary ejection based on the user's need with the type (recording mode) and characteristics of recording image in mind.

Second Embodiment

The configuration of a second embodiment is the same as that of the first embodiment. The following mainly describes the operation that is different from that in the first embodiment.

Figure 13:
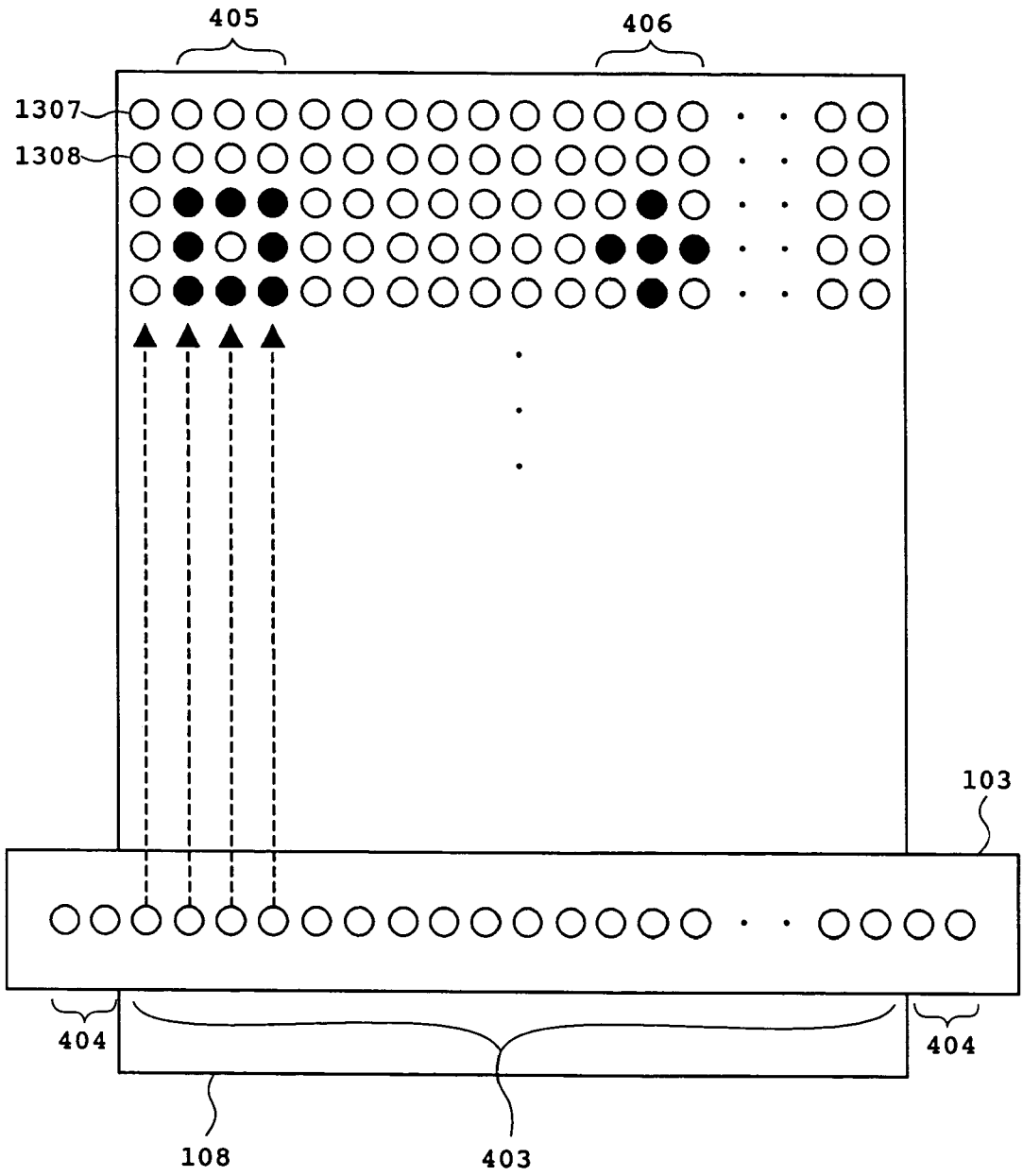
FIG. 13 is a diagram showing a second embodiment of the present invention.

FIG. 13 is a diagram showing the second embodiment wherein an example of an image is recorded on a paper 108 by a line head 103. In this case, too, the line head 103 has an effective nozzle group 403 of 2400 dots for the paper size with adjustment areas 404 on both sides of the nozzle group 403. FIG. 13 does not show a preliminary ejection pattern of the paper preliminary ejection. The black dot parts of recorded images 405 and 406 are recorded parts into which ink is ejected from the nozzles of the line head 103.

As shown in FIG. 13, blank lines 1307 and 1308, each composed of all blanks, can usually be included in the recorded result. To reduce the amount of data to be transferred, the information on those blank lines is sometimes transferred using a line skip command. This line skip command, a command for bypassing recording the whole one line, is generated in the same manner as the paper vertical/horizontal size command (size information) The line skip command can be represented by seven bytes for any number of consecutive lines.

On the other hand, one line (2400 dots) of 00 (hexadecimal), if compressed according to the PackBits compression method described in the first embodiment, requires six bytes for each line because 2400 dots are equivalent to 300 bytes and the maximum number of consecutive bytes in the PackBits compression method is 128 bytes. This means that the seven-byte line skip command should be used for two or more consecutive lines to reduce the amount of data. An inkjet recording device in this embodiment processes recording data that includes the line skip command.

Figure 14:
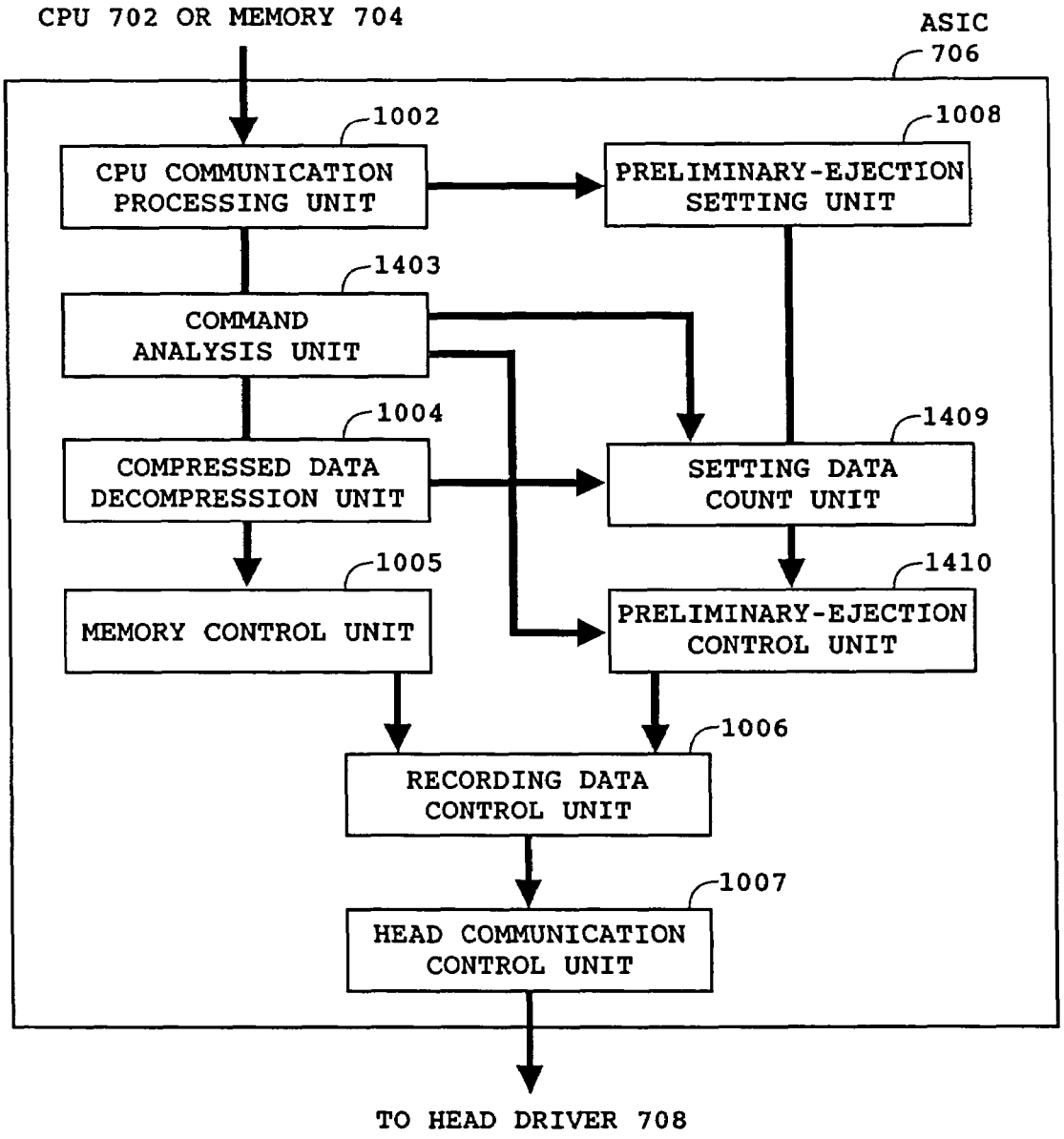
FIG. 14 is a diagram showing another internal configuration of the ASIC installed on the control substrate of the head module in the second embodiment of the present invention.

FIG. 14 shows another internal configuration of an ASIC 706 installed on the control substrate of a head module 101 in the second embodiment. The same reference numerals are used for the corresponding elements of the ASIC 706 shown in FIG. 10. The ASIC 706 has a command analysis unit 1403 that analyzes the line skip command and sends the result to a setting data count unit 1409 and a preliminary ejection control unit 1410.

Figure 15:
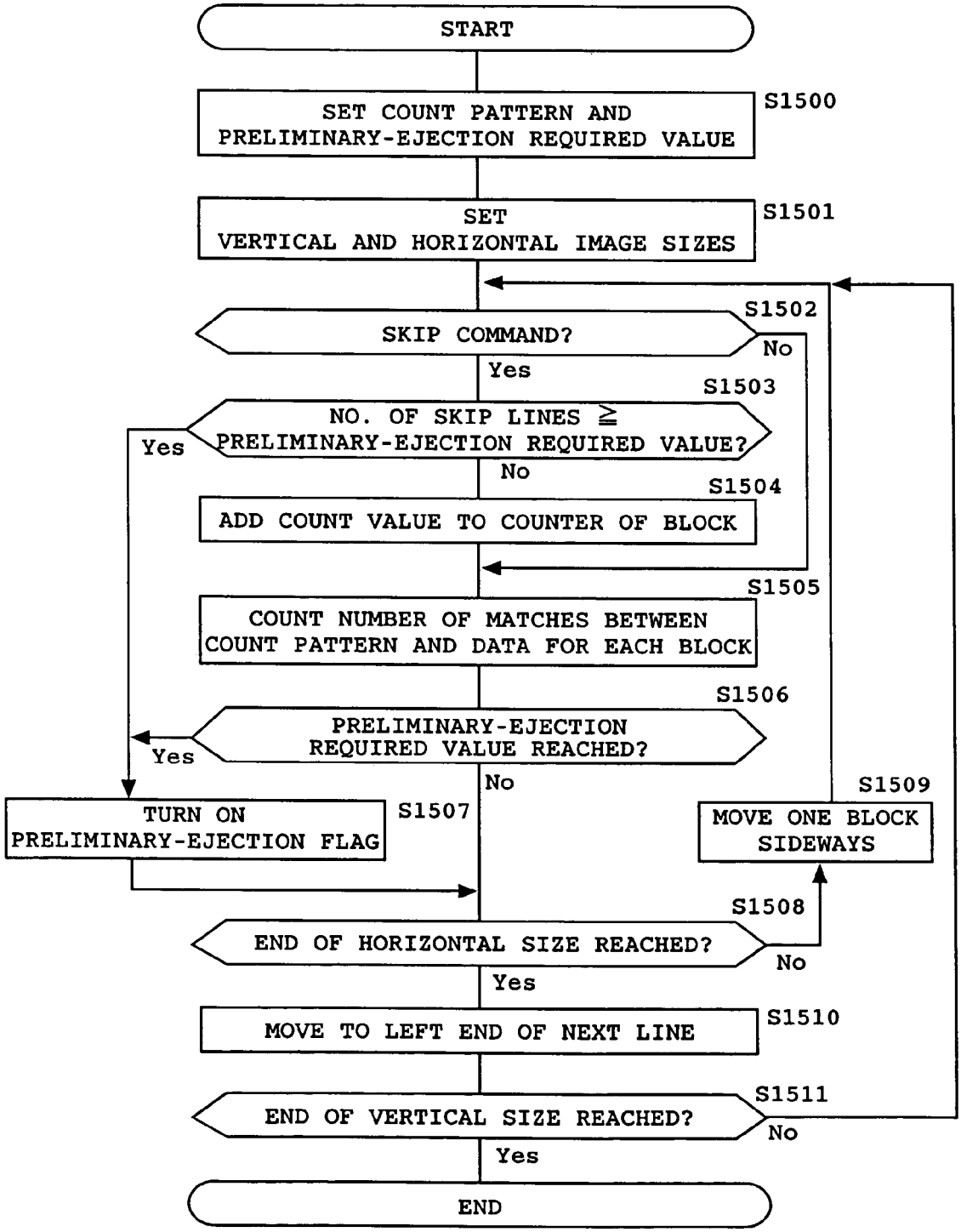
FIG. 15 is a flowchart showing the control method of the ASIC installed on the control substrate of the head module in the second embodiment of the present invention.

FIG. 15 is a flowchart showing the control method of the ASIC 706 installed on the control substrate of the head module 101 in the second embodiment.

In the second embodiment, a preliminary ejection required value and a preliminary ejection count pattern are set in a preliminary ejection setting unit 1008 via a CPU communication processing unit 1002 as in the first embodiment (S1500). The command analysis unit 1403 analyzes the image vertical/horizontal size command, data color command, and so on and sets the image vertical/horizontal size in the setting data count unit 1409 (S1501).

The command analysis unit 1403 analyzes the line skip command (S1502) and checks if the number of consecutive lines to be skipped is equal to or larger than the preliminary ejection required value obtained in the same manner as in the first embodiment (S1503). If the number of lines is equal to or larger than the preliminary ejection required value, the command analysis unit 1403 turns on the preliminary ejection flag for preliminary ejection (S1507).

If the number of lines is less than the preliminary ejection required value, the command analysis unit 1403 increments (or decrements for counting down) the counters of the blocks (1205 to 1207 in FIG. 12) by the number of lines (S1504). Preliminary ejection is required for the nozzles from which ink is not ejected and thus it is impossible, from the purpose of preliminary ejection, that the preliminary ejection count pattern of 00 (hexadecimal) is not set but only other patterns such as 01 (hexadecimal) are set. Because a blank line is 00 for all blocks, a count pattern match occurs for all blocks. Therefore, when the line skip command is found, the count value can be added directly to (or decremented directly from) the counters of the blocks (1205-1207 in FIG. 12).

The processing of the subsequent steps S1508-S1511 is the same as that of steps S1106-S1109.

As described above, a line skip command is detected and analyzed in the second embodiment. This eliminates the need for processing for each block when a blank line is found, thus determining whether to execute preliminary ejection more quickly.

Third Embodiment

The configuration of a third embodiment is almost the same as that of the first and second embodiments. The following describes only the configuration that is different from that in the first and second embodiments.

Figure 16:
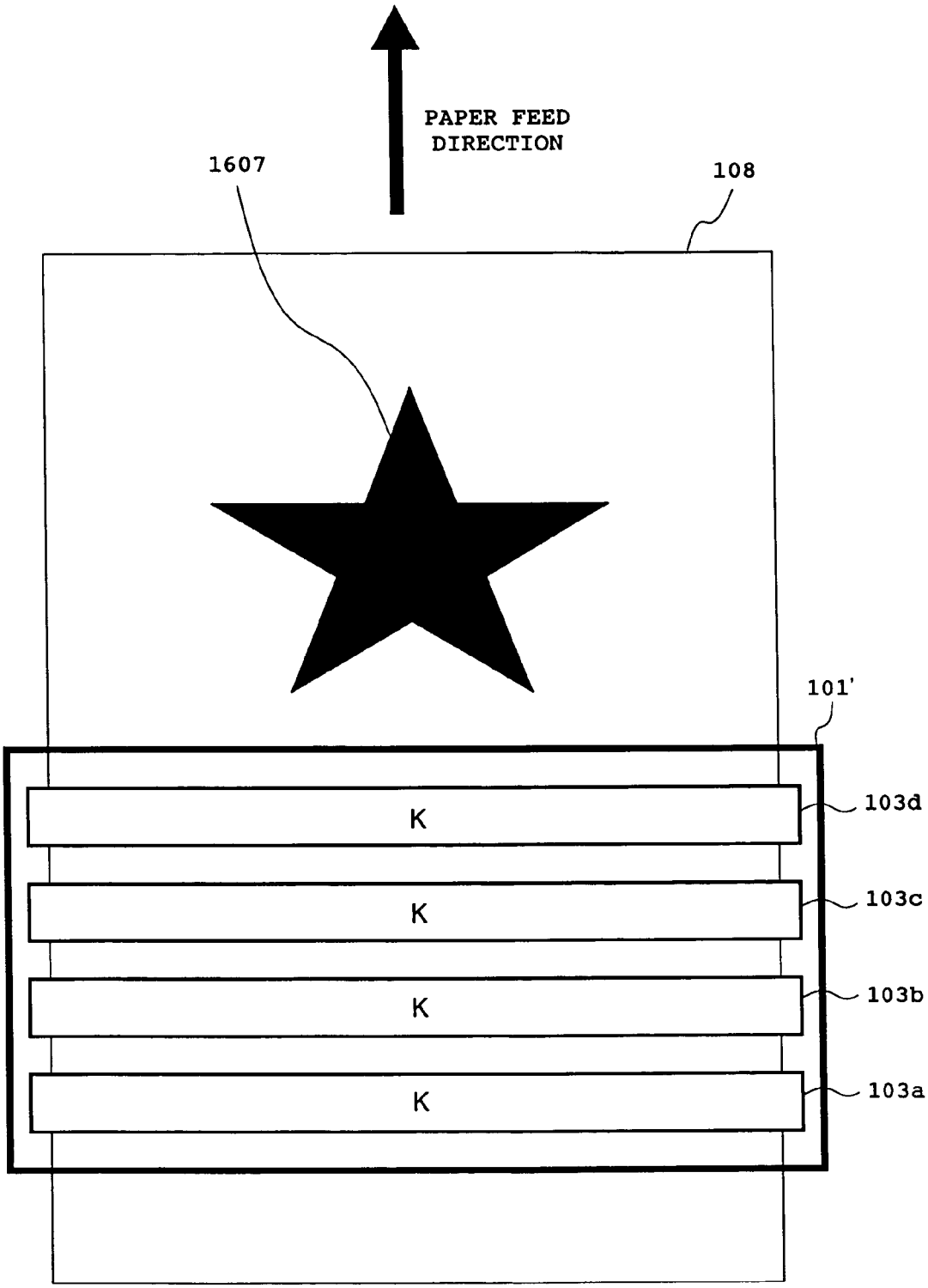
FIG. 16 is a diagram showing how an image is recorded using the head module in a third embodiment of the present invention.
Figure 17:
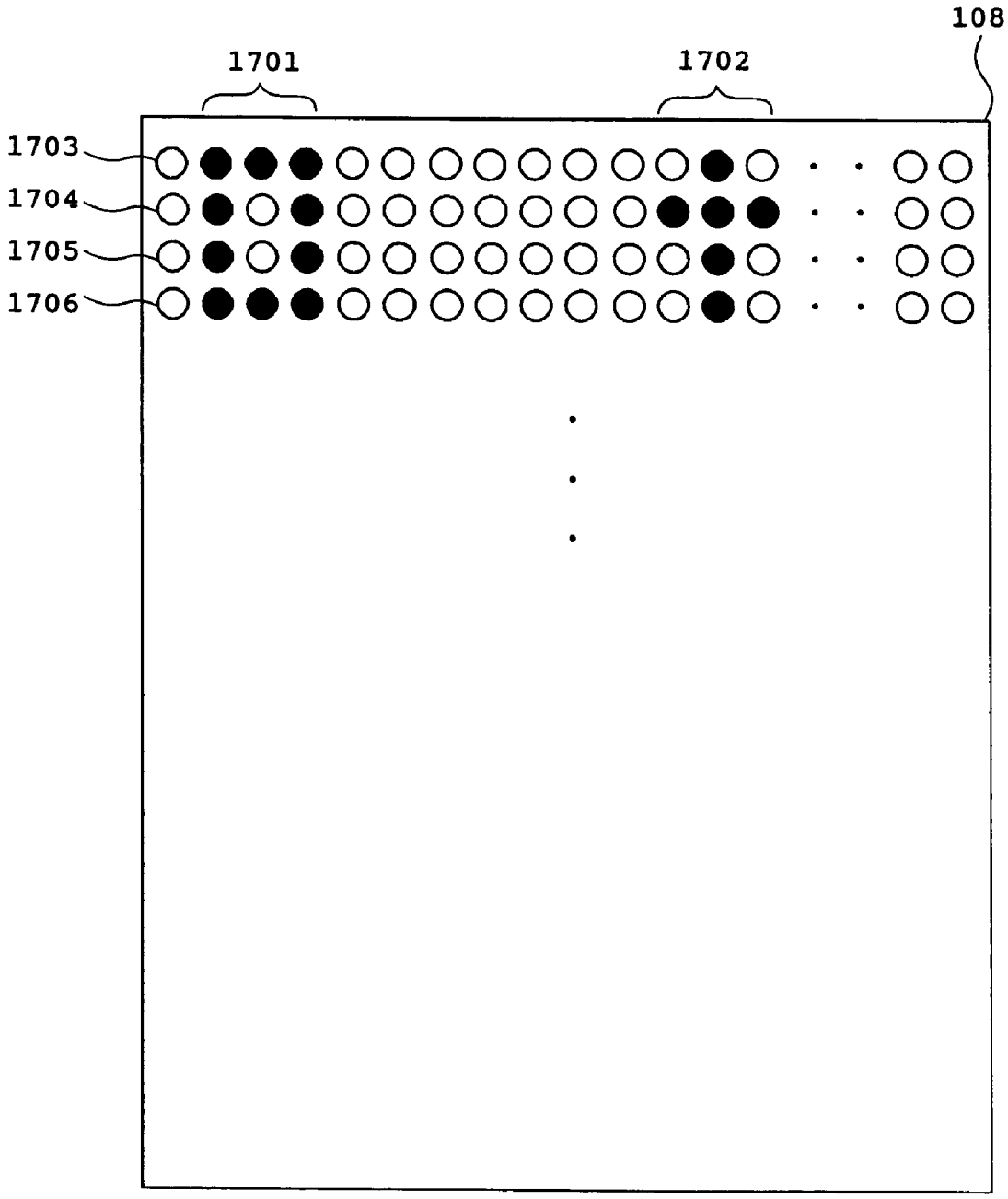
FIG. 17 is a diagram showing how an image is recorded using a plurality of the same-color head lines in the head module shown in FIG. 16.

FIG. 16 shows a head module with the same configuration as that of the head module 101 in FIG. 3 except that the same ink color is ejected from line heads 103*a*-103*d* (black in this example). In this configuration, a plurality of lines, 1703-1706, that constitute recorded images 1701 and 1702 correspond to the line heads as shown in the example of a recorded result in FIG. 17; that is, the line 1703 corresponds to the line head 103*a*, the line 1704 corresponds to the line head 103*b*, the line 1705 corresponds to the line head 103*c*, and the line 1706 corresponds to the line head 103*d*. The line 1707 corresponds again to the line head 103*a*. Dividing the image into four parts and allocating each line head to one of the parts increases the transfer speed and the recording data processing speed with the result that the throughput becomes four times higher in the transfer speed as compared with that of image recording in which the image is recorded with one line head (FIG. 17 does not show the ejection pattern of the paper preliminary ejection).

The configuration and the operation of the head module described above, where recording data of the same color is divided into multiples for processing by multiple line heads, requires a processing mode different from that of the embodiments described above. In the first and second embodiments in which data sent from the PC is compressed for each color in advance, the command analysis unit 1003 analyzes the color code and then the setting data count unit corresponding to the color counts the occurrences of the count pattern. However, on the head module 101' in FIG. 16, the count unit cannot be selected in the same manner. That is, because whether to preliminarily eject ink is determined for each line head, it is necessary to divide the recorded data of the same color into parts each of which corresponds to one of line heads. Thus, the following method is used.

Figure 18:
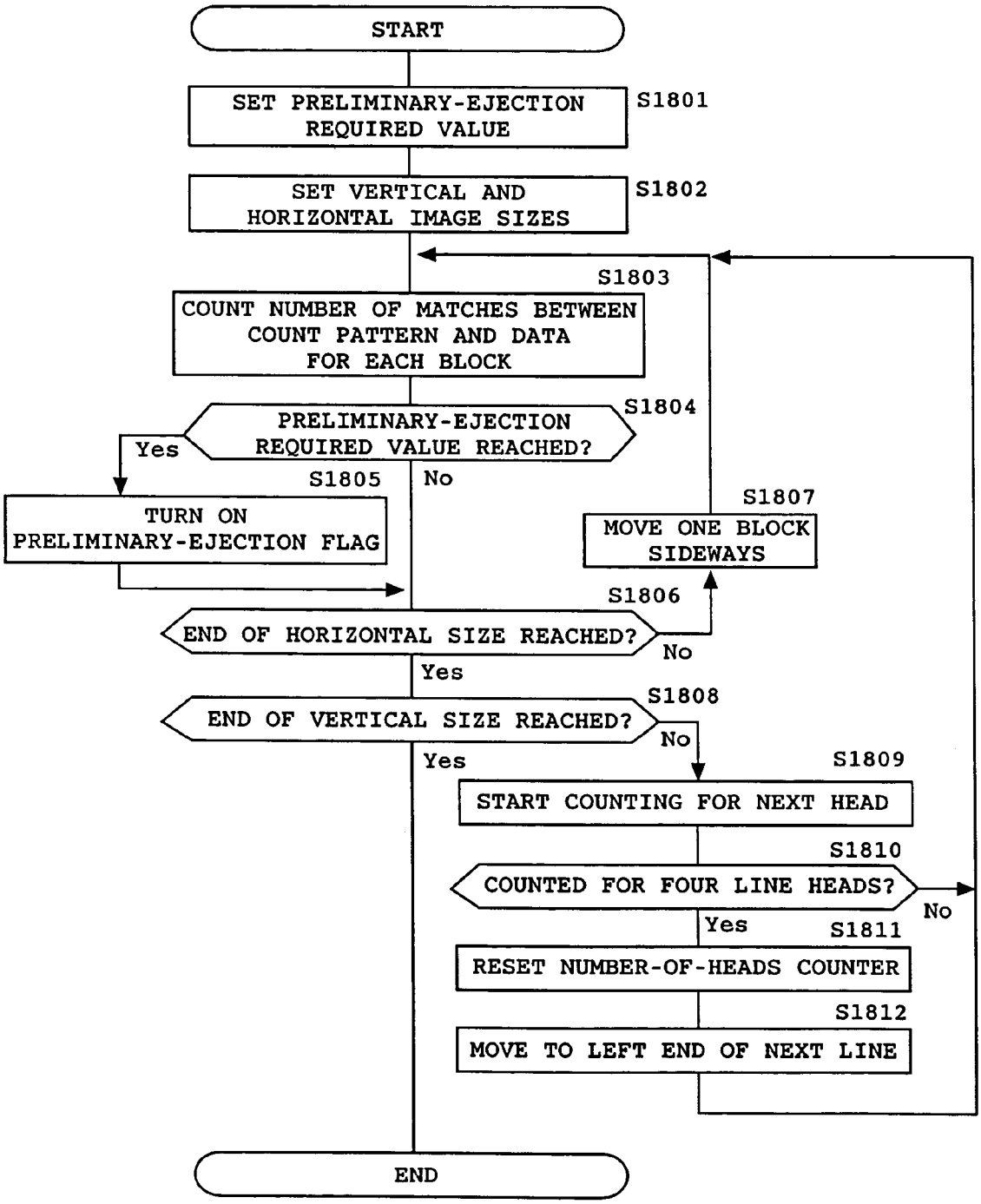
FIG. 18 is a flowchart showing the control method of the third embodiment of the present invention.

FIG. 18 is a flowchart showing the control operation in the third embodiment.

Steps S1801-S1807 are the same as steps S1101-S1107 in FIG. 11.

If the end of the horizontal size of one line is reached (Yes in S1806) after starting the counting based on the horizontal image size analyzed by the command analysis unit 1003, whether the end of the vertical image size that was set in step 1802 is reached is checked (S1808).

If the end of the vertical image size is not yet reached, the counting of the count patterns is started to determine whether to preliminarily eject ink from the next head (S1809).

In this embodiment in which the head module 101' has four line heads of the same color, whether the counting has been finished for the four lines heads is checked (S1810). If the counting has not yet been finished for the four line heads, control is returned to step S1803. If the counting has been finished for the four line heads, the number-of-heads counter is reset (S1811) and control is passed to the step for counting the count patterns in the leftmost block in the next line (S1812). Control is then returned to step S1803 and the counting is continued for the first line head 103*a*. When the end of the vertical image size is reached, the processing is terminated as in the first embodiment.

Although an inkjet recording device with four line heads of the same color is used as the example in the third embodiment, an inkjet recording device with five or more or three or less line heads can also be implemented by providing preliminary ejection counters, one for each line head, as in the first embodiment.

In the third embodiment, even when recording data of one color is sent to the inkjet recording device with a plurality of line heads of the same color as described above, it is possible to determined whether to preliminarily eject ink from the line heads.

Fourth Embodiment

Figure 19:
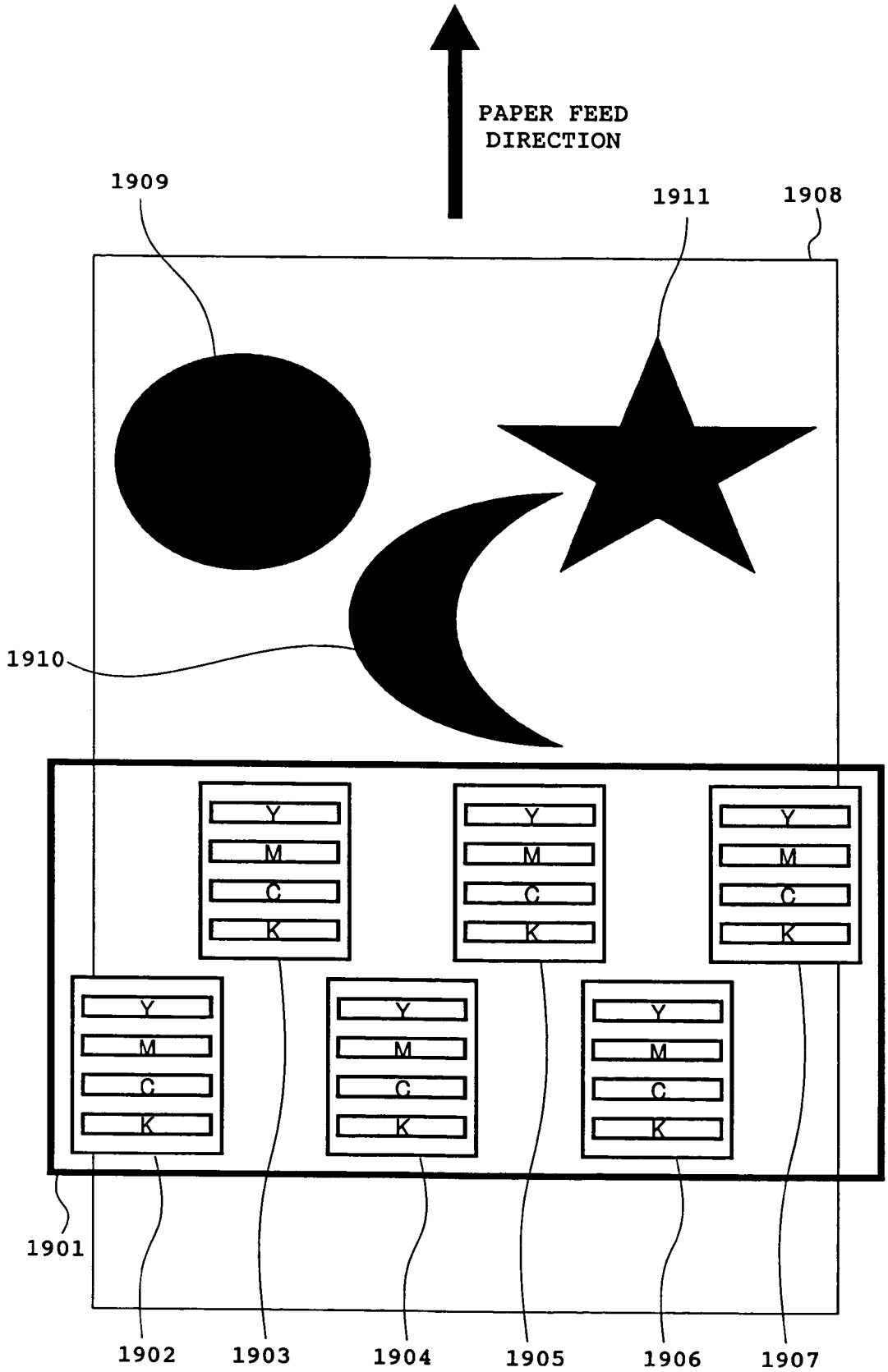
FIG. 19 is a diagram showing the configuration and the recording result of a head module in a fourth embodiment of the present invention.

FIG. 19 shows the configuration of a head module 1901 in this embodiment. This head module 1901 has sub-head modules 1902-1907, each corresponding to the head module 101 in FIG. 3, arranged as shown in the figure to allow an image to be recorded on a wide paper 1908. In the fourth embodiment in which the sub-head modules 1902-1907, each containing four four-inch line heads, are arranged horizontally, an inkjet recording device capable of recording the maximum of 24 inches in width can be configured. To ensure continuity in the horizontal recording dots, the sub-head modules 1902-1907 are shifted each other in the paper feed direction. This shift is corrected by adjusting the time at which ink is ejected from the sub-head modules at recording time. The sub-head modules 1902-1907 work together to record graphics 1909-1911 on the wide paper 1908.

In the fourth embodiment, too, it is possible to apply the counting of count patterns described in the first and second embodiments, which is performed for determining whether to preliminarily eject ink, to the sub-head modules 1902-1907 for ensuring optimum preliminary ejection. Although the head modules corresponding to the head module 101 in the first embodiment are used in FIG. 19, the head module corresponding to the head module 101' in the third embodiment shown in FIG. 16 may also be arranged as the sub-head modules 1902-1907 in FIG. 19 to configure a single-color, wide inkjet recording device.

In the inkjet recording device in the fourth embodiment in which a plurality of head modules are used, whether to preliminarily eject ink from line heads can be determined for each of the head modules. Thus, this embodiment gives the same effect as that of other embodiments.

In the first to fourth embodiments, an inkjet recording device using line heads has been described. On an inkjet recording device where a plurality of nozzles of a head are grouped into blocks and the occurrences of a count pattern can be counted for each block, whether to preliminarily eject ink need not be determined on a line head basis and, therefore, the present invention can also be applied to such an inkjet recording device.

Fifth Embodiment

Next, a fifth embodiment of the present invention will be described.

A recording device in this embodiment is similar to that shown in FIG. 1 and FIG. 2, and the basic recording operation of the head module is also the same.

As described above, the following operations are performed to maintain good recording performance of the inkjet recording heads: the preliminary ejection operation for nozzles from which ink has not been ejected for a predetermined time, the wipe operation with the use of a wipe blade for wiping ink droplets built up near the nozzles as a result of successive, accumulated ejections, and the forced pressurization recovery operation for ejecting bubbles formed inside the nozzles or for removing high-viscosity ink near the nozzles.

This embodiment relates mainly to the wipe operation, one of the recovery operations described above, in which a wipe blade (not shown) installed on the recovery unit 107 in FIG. 1 moves right and left.

The sub-head modules in this embodiment are the same as those shown in FIG. 19 with each sub-head module having recording heads (YMCK). The plurality of sub-head modules 1902-1907 work together to record different parts of an image in the width direction of a paper 108.

Figure 20:
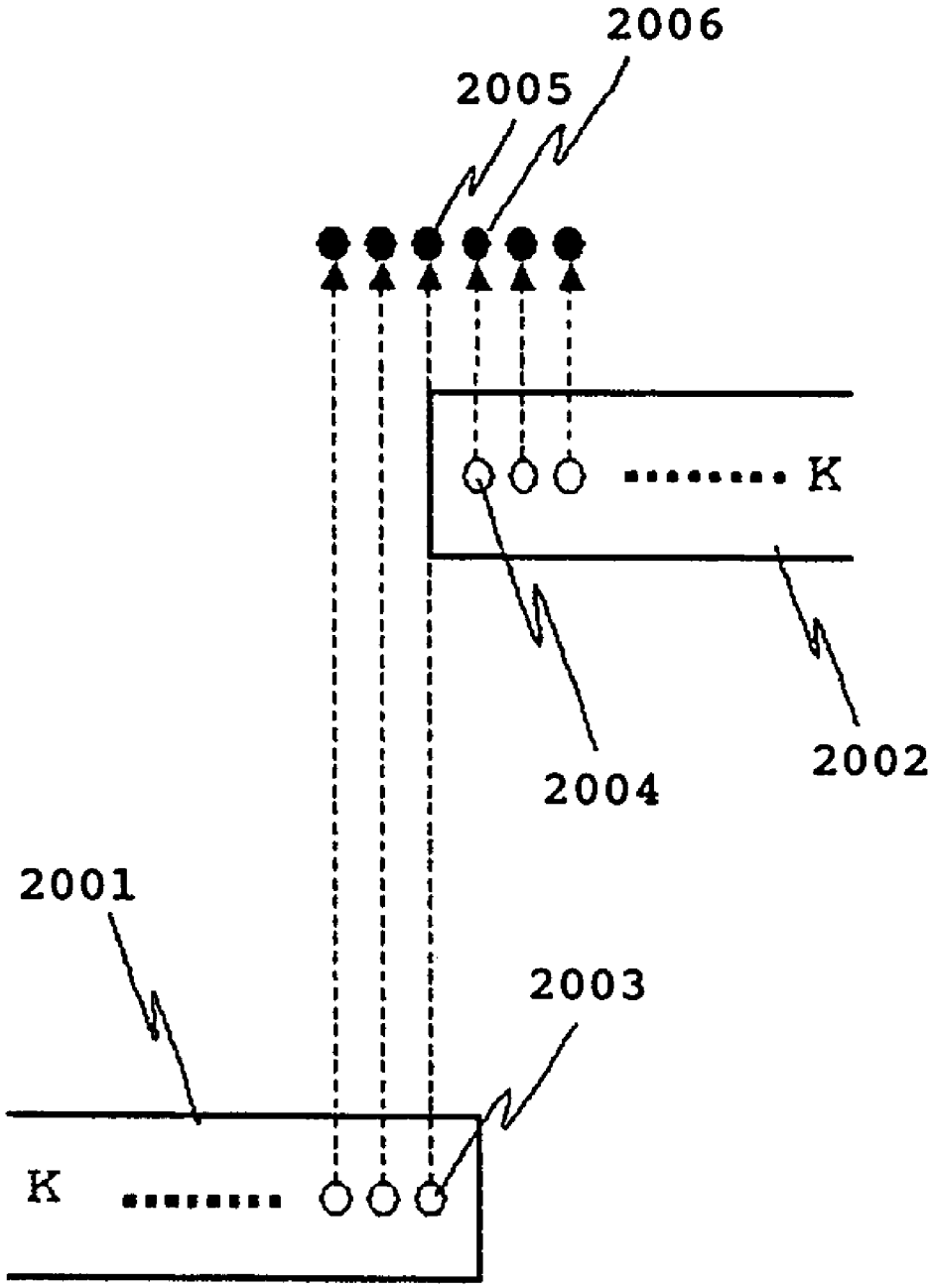
FIG. 20 is a diagram showing the detail of the recording method of the K (black) heads of the neighboring sub-head modules in a fifth embodiment of the present invention.

FIG. 20 is a diagram showing the relative arrangement of the K (black) heads of the neighboring sub-head modules 1902 and 1903 and the detailed recording method indicating the nozzles that record an image. Ink droplets 2005 and 2006 are ejected from nozzles 2003 and 2004 of different recording heads 2001 and 2002, and the ink droplets are combined to form an image as shown in FIG. 20. In the example shown in the figure, the ink droplets 2005 and 2006 form a part of a horizontal line.

Figure 21:
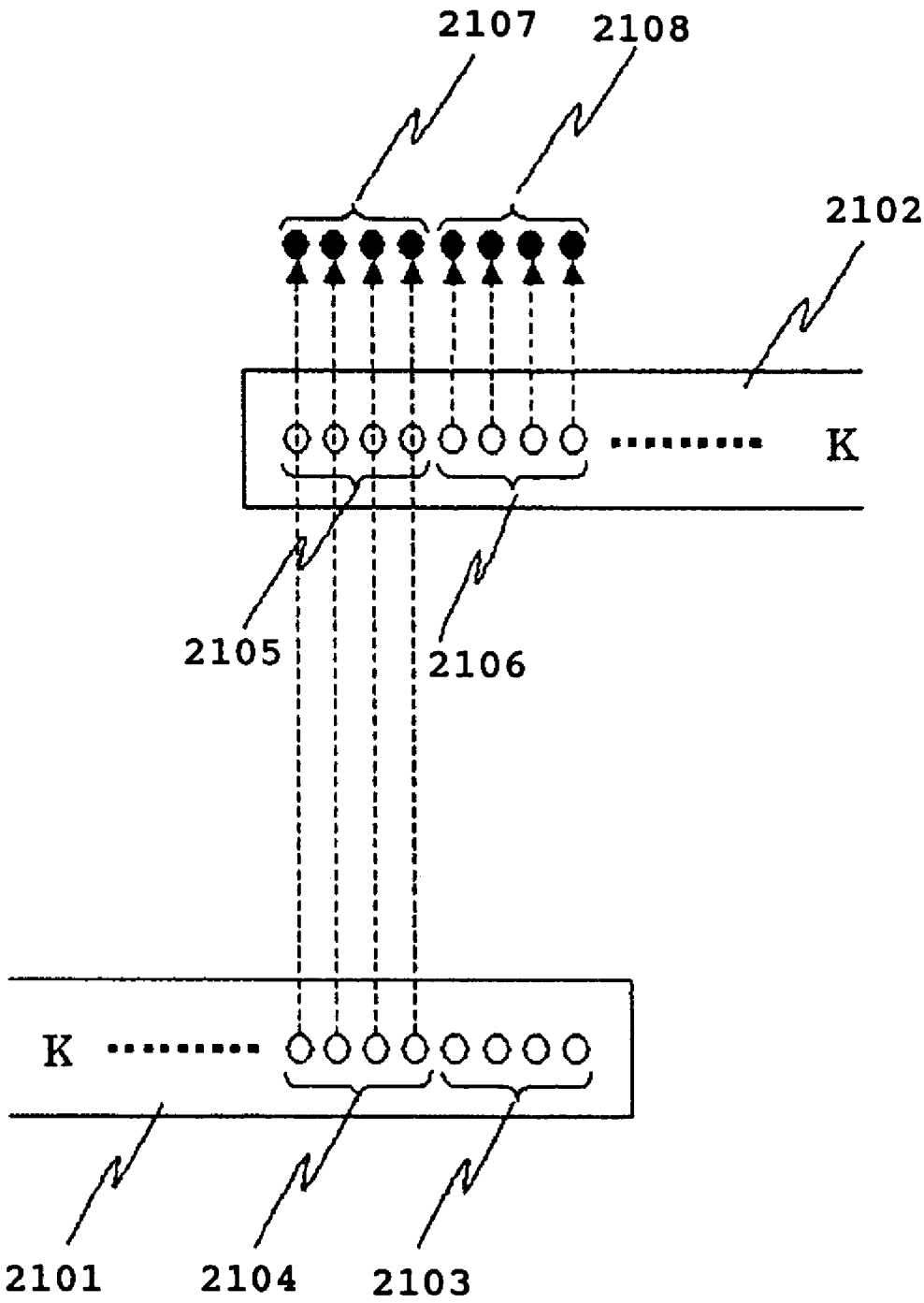
FIG. 21 is a diagram showing the detail of another recording method of the K (black) heads of the neighboring sub-head modules in the fifth embodiment of the present invention.

FIG. 21 shows a second recording example different from that shown in FIG. 20. Connecting parts, 2107 and 2108, of an image are recorded by the nozzles of different recording heads 2101 and 2102 as in the example shown in FIG. 20. The difference is that, in the example in FIG. 21, the image part 2107 is formed by the droplets from the plurality of nozzles 2104 and the image part 2108 is formed by the droplets from the plurality of nozzles 2106.

In this case, the nozzles 2103 and 2105 at the end of the recording heads are redundant nozzles for adjusting registration. They are provided to electrically correct a slight misalignment in the physical position in the paper width direction that is caused because the line heads 2101 and 2102 are installed on different head holders 102. For example, if the line head 2101 is shifted one dot to the left, the image part 2107 is recorded using the rightmost three dots of the nozzle 2104 and one leftmost dot of the nozzle 2103.

As in the paper width direction, a physical positional misalignment is caused between different recording heads in the paper feed direction. This misalignment is corrected by the output of an encoder, not shown, provided for controlling the paper feed position and the feed speed.

Although the sub-head modules 1902-1907 are arranged as shown in FIG. 19, this embodiment can also be realized by the arrangement that is changed considering the recording direction and the recording data transfer sequence.

The substrate for controlling a head module in this embodiment is the same as the substrate 701 shown in FIG. 7. This substrate 701, installed on each of the sub-head modules 1902-1907, stores data sent from the PC (information processing unit) to the sub-head modules 1902-1907.

In the example of the recording device 602 in this embodiment, recording data from the PC is divided into six parts each of which is sent to one of the sub-head modules 1902-1907.

Figure 22:
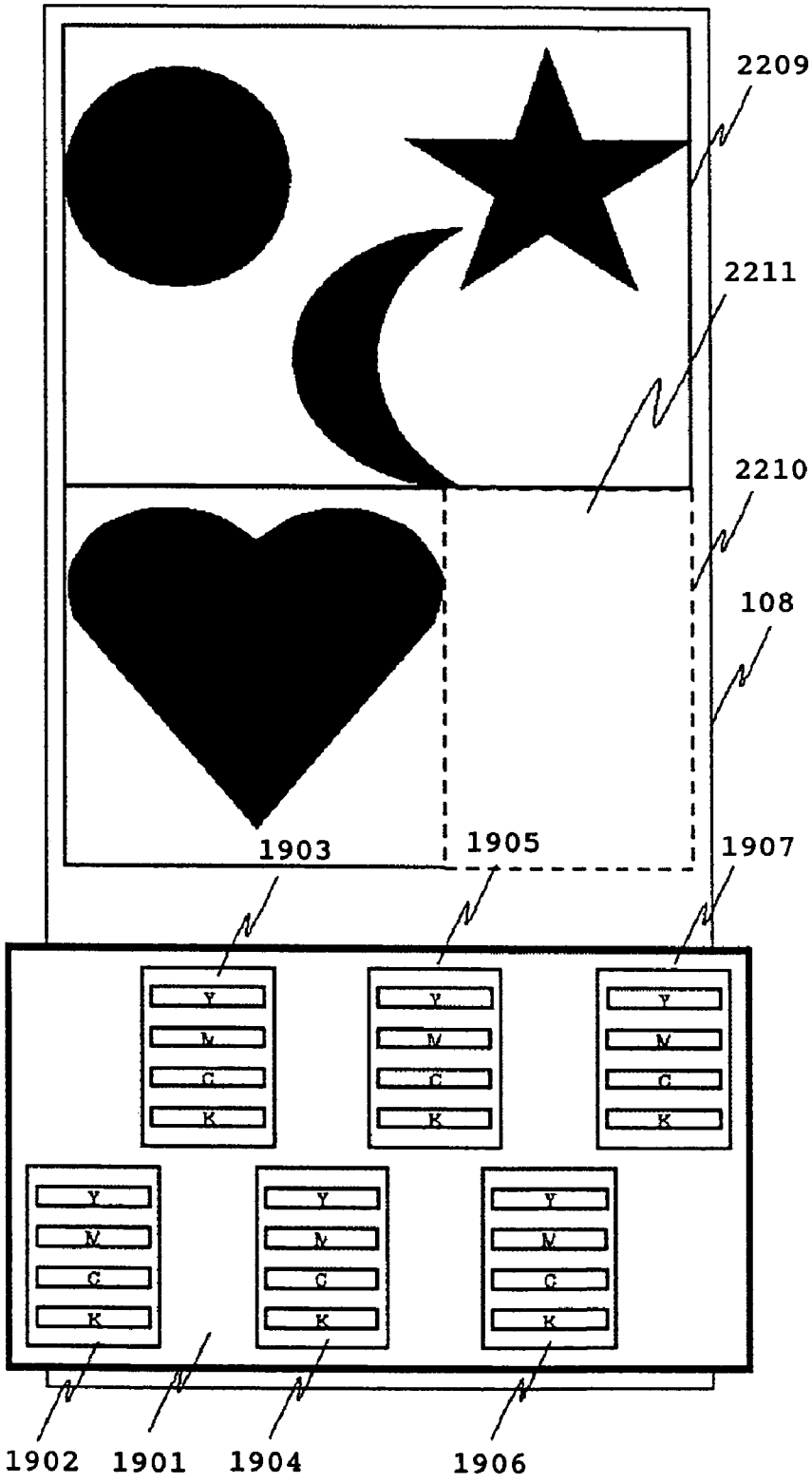
FIG. 22 is a diagram showing an example of an image recorded on a paper in the fifth embodiment of the present invention.

FIG. 22 shows an example of an image recorded on the paper 108 in this embodiment.

The figure shows a recorded result, that is, a printed matter 2209 on the first page of the paper 108 and a printed matter 2210 on the second page. They are printed by a recording device 1901 using the sub-head modules 1902-1907.

In this embodiment, the substrates 701 of the sub-head modules 1902-1907 of the recording device 1901 receive recording data of the first-page printed matter 2209 from the PC and then the recording device starts printing. The reception of the recording data of the second-page 2210 is completed while data is recorded on the first page 2209. After printing data on the first page 2209, data is continuously recorded on the second page 2210.

Data is recorded on the first page 2209 using all sub-head modules 1902-1907. When printing data on the second page 2210, the CPUs 702 of the sub-head modules 1906 and 1907 receive recording data to be recorded on the second page 2210 but find that there is no recording data. Therefore, when recording data on the second page 2210, the recording device does not move to the print state shown in FIG. 2 but prints data using the sub-head modules 1902-1905. For the part 2211 where there is no print data, a no-data command is sent from the PC to specific sub-head modules to eliminate the need for the CPU 702 to search for print data.

On the other hand, when an image extending almost evenly in the paper width direction such as the recording data 2209 is recorded, the approximate number of accumulated recorded pixels ejected from the nozzles of the line heads installed on the sub-head modules 1902-1907 is even among them and, therefore, the recovery processing interval and the recovery processing contents may be approximately the same among them to maintain the good performance of the line heads. However, when recording data distributed unevenly (only in one part of the paper) in the paper width direction such as the recording data 2210 appears continuously, the difference in the number of accumulated recorded pixels between the sub-head modules 1902-1905 and the sub-head modules 1906-1907 for which there is no data to be recorded becomes large as the number of recorded pages increases. At the same time, because the sub-head modules 1906 and 1907 do not move to the recording state when recording the recording data 2210, the recovery operation processing interval and the recovery processing contents should be greatly different from those for sub-head modules 1902-1905.

That is, in this embodiment, the CPU 702 reads the numbers of accumulated recorded pixels ejected from the line heads of the sub-head modules 1902-1907 for the blocks of the recording heads and successively overwrites those numbers in the memory on the substrate 701 for controlling the operation. This method prevents the recovery processing interval and the processing contents from being the same among the sub-head modules 1902-1907. As a result, it becomes possible, depending upon the contents of an image, to perform the recovery operation for some head modules while continuing the print operation using the rest of sub-head modules and thereby to reduce the wasteful time for the recover operation. Forced ejection of ink, if carried out during the recovery operation, could reduce the amount of wasteful ink.

Another advantage is that the method described above requires less time to complete the recording a predetermined number of copies and at the same time reduces the print cost per copy of a printed matter.

Figure 23A:
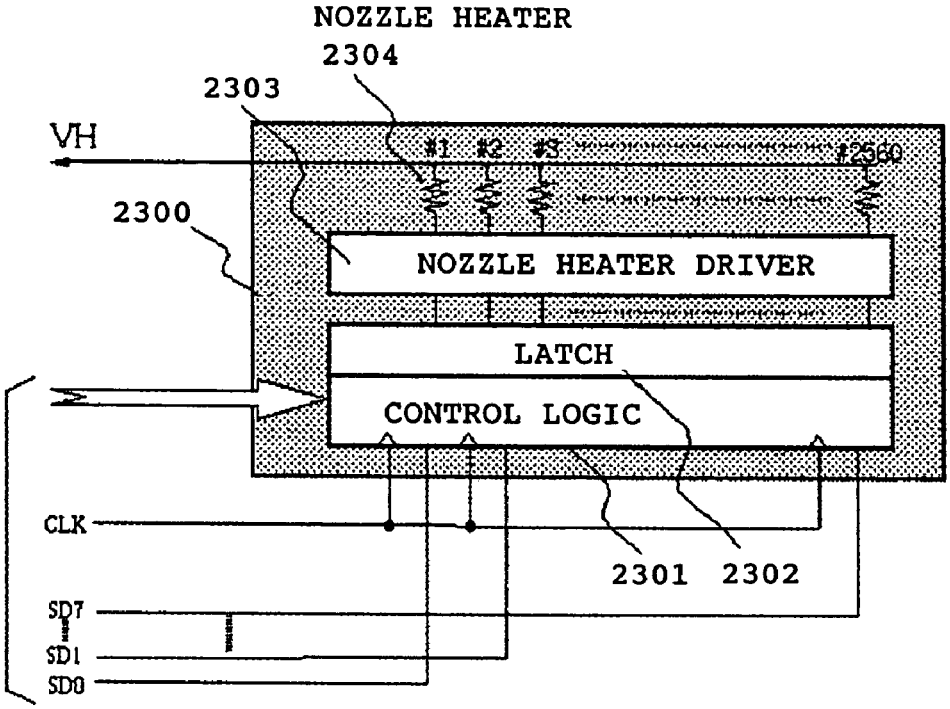
FIG. 23A and FIG. 23B are diagrams showing the number of recording elements of the recording head and how to count the number of accumulated recorded pixels in the fifth embodiment of the present invention.
Figure 23B:
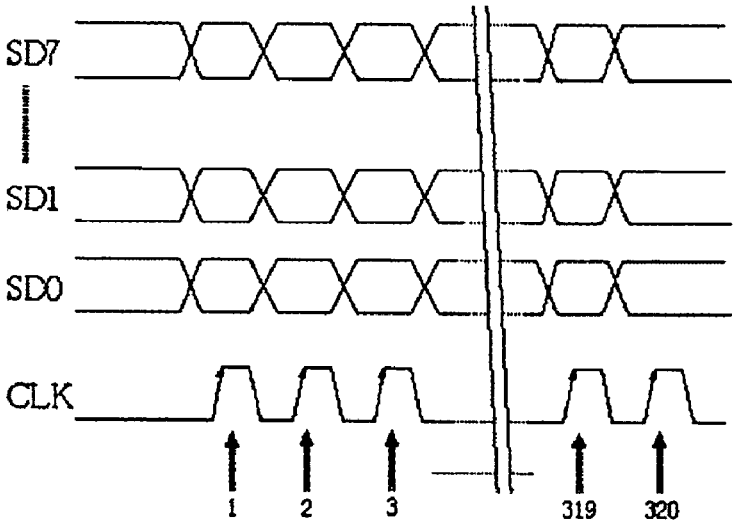

The following describes how to count the number of recorded pixels and the number of accumulated recorded pixels of a recording head with reference to FIG. 23A and FIG. 23B.

As shown in FIG. 23A, a recording head 2300 included in the sub-head modules 1902-1906 comprises nozzle heaters 2304 that cause ink to be ejected from the nozzles, nozzle heater drivers 2303 each made of a drive transistor, latches 2302 that turn on/off the nozzle heater drivers, and a control logic 2301 that sends recording data SD0-SD7 to a shift register (not shown) in synchronization with the shift clock CLK. VH represents the driving voltage for driving the nozzle heaters, for example, +24[V].

The recording head 2300 in this embodiment has 2560 nozzles (ink ejection outlets) as well as nozzle heaters #1-#2560 and nozzle heater drivers, one for each nozzle. The recording resolution is 600 [dots/inch]. Therefore, the maximum recording width is about 4.3 [inches].

When recording data for recording an image is transferred, the 2560 nozzles are divided into eight 320-nozzle blocks for control purposes with the recording data signal (SD0-SD7) connected to each block. As shown in FIG. 23B, the 320-nozzle serial data is serially read on the rising edge of the common clock signal (CLK) to receive one-line (raster) (2560 nozzles) of recording signals of the recording head 2300. The value of "1" of the recording data signal (SD0-SD7) means "eject", and the value of "0" means "do not eject".

The signals are controlled and output by the head driver (control circuit) 708. For one recording head 2300, the head driver 708 has eight number-of-recorded-pixels counters, one for each block. The head driver counts the number of "1's" (recorded) of the recording data signal (SD0-SD7) in FIG. 23B to count the number of recorded pixels in each block in one raster. The value of the counter is serially accumulated in the counter as the number of accumulated recorded pixels of each block. By accumulating the value in the counter of each block, the number of accumulated recorded pixels in a limited space of the recording head can be identified and, thus, the growth of ink droplets (ink to be wiped) near the nozzles of the recording head that did not contribute to the recording can be predicted.

Figure 24:
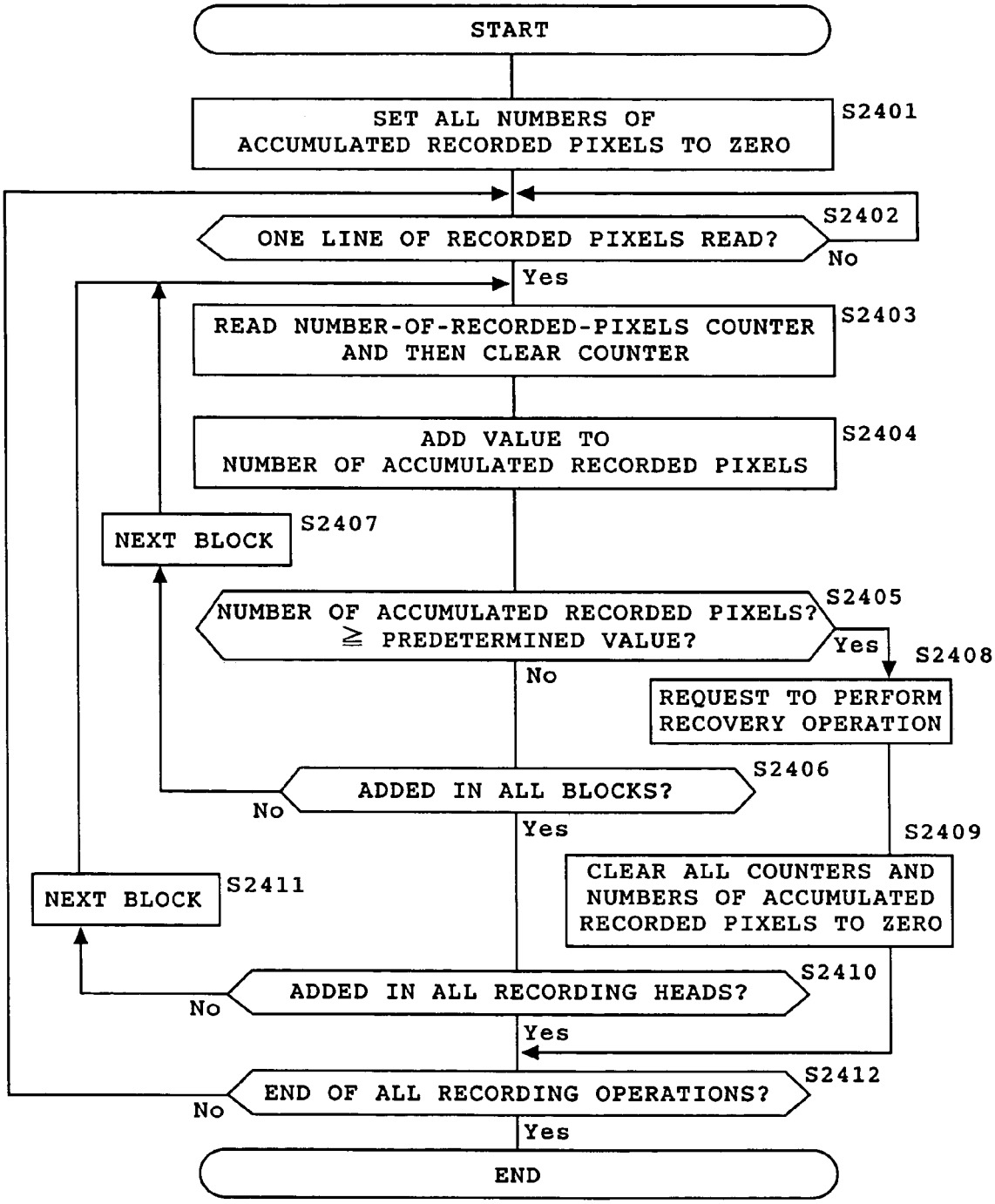
FIG. 24 is a flowchart showing the recording operation and the recovery processing of the recording head in the fifth embodiment of the present invention.

Next, with reference to FIG. 24, the following describes the flow of the recording operation and the recovery operation for the recording heads executed by the CPU 702 using the hardware described above.

First, the CPU 702 initializes (for example, set to zero) the numbers of accumulated recorded pixels, stored in the memory 704, of all blocks of all recording heads (S2401) and starts the recording operation.

Next, when one line (raster) of recorded pixels are read into the head driver 708 (Yes in S2402), the value output in the number-of-recorded-pixels counter is read (S2403) and is added to the number of accumulated recorded pixels in the memory 704 (S2404). Immediately after read, the number-of-recorded-pixels counter is cleared.

If the number of accumulated recorded pixels after the value of the number-of-recorded-pixels counter is added exceeds a predetermined value (Yes in S2405), a request to perform the recovery operation for all recording heads are issued immediately (S2408), all counters for all recording heads and the numbers of accumulated recorded pixels are cleared to zero (S2409), and the operation led to step S2412. In this embodiment, when the condition in step S2405 is met the recovery operation is performed for all recording heads. However, the recovery operation may be performed for only one recording head for which the number of accumulated recorded pixels has been examined.

If No in S2405, whether the value of the number-of-recorded-pixels counter has been added to the number of accumulated recorded pixels in all blocks of the recording head is checked. If No (No in S2406), the processing proceeds to the next block (S2407) and then to S2403 to repeat the processing.

If the addition processing described above has been completed in all blocks in the recording head (Yes in S2406), whether the addition has been completed in all recording heads is checked. If No (No in S2410), the processing proceeds to the next recording head (S2411) and then to S2403 to repeat the processing.

If the value of the number-of-recorded-pixels counter has been added to the number of accumulated recorded pixels in all blocks in all recording heads in one line (raster) (Yes in S2410), whether the predetermined recording operation has been completed is checked (S2412). If No, control is passed back to S2402 and processing proceeds to the next line (raster).

The processing described above is repeated until the predetermined recording operation is terminated and then the processing is terminated.

As described above, it is considered that the growth of ink droplets due to mists near the inkjet ejection nozzles is slow in a block or a recording head where the number of accumulated recorded pixels is small. Therefore, according to the embodiments of the present invention, the number of recovery operations for wiping the recording heads with wiper blades can be reduced while maintaining high image quality. As a result, the number of interruptions during the recording operation is reduced according to the contents of an image.

Although the example has been described in which each sub-head module includes a plurality of recording heads, the present invention is applicable also to a recording device including a single recording head in each sub-head module for monochrome printing.

The embodiments of the present invention are applicable to a recording device capable of quickly recording an extremely high-quality image on a relatively large printed matter such as a corrugated fiberboard.

What is claimed is:

1. An inkjet recording device comprising:

a recording head composed of a sequence of nozzles from which ink is ejected; and head control means for ejecting ink droplets from the sequence of nozzles of said recording head based on recording data and for controlling a preliminary ejection operation to keep an ink ejection state of said recording head in good condition;

wherein said head control means comprises:

counting means that analyzes the recording data for counting a number of consecutive occurrences of a predetermined count pattern for each of nozzle blocks, said sequence of nozzles of the recording head being divided into the nozzle blocks each composed of a plurality of nozzles, said count pattern being representative of at least one predetermined pattern of the recording data of a size corresponding to the nozzle block, a count value of said counting means being reset each time said consecutive occurrences end; and determination means for determining for each block if the count value of said counting means has reached a predetermined value;

wherein, if there is at least one block where the count value has reached the predetermined value, preliminary ejection processing is performed for said recording head.

2. The inkjet recording device according to claim 1 wherein said control means detects an end of one line based on a horizontal image size included in image size information associated with the recording data.

3. The inkjet recording device according to claim 1 wherein said control means detects an end of a page based on a vertical image size included in image size information associated with the recording data.

4. The inkjet recording device according to claim 1 wherein, when a line skip command that is used to skip a recording of one whole line is detected and if a detected number of consecutive lines to be skipped is equal to or larger than a predetermined number, said control means performs preliminary ejection processing immediately.

5. The inkjet recording device according to claim 4 wherein, when a line skip command is detected and, if a detected number of consecutive lines to be skipped is smaller than the predetermined number, said control means adds the number of lines to a count value of each block.

6. The inkjet recording device according to claim 1 wherein said recording head is a line head.

7. An inkjet recording device comprising:

a recording head composed of a sequence of nozzles from which ink is ejected; and head control means for ejecting ink droplets from the sequence of nozzles of said recording head based on recording data and for controlling a preliminary ejection operation to keep an ink ejection state of said recording head in good condition;

wherein said head control means comprises:

counting means that analyzes the recording data for counting a number of consecutive occurrences of a predetermined count pattern for each of nozzle blocks, said sequence of nozzles of the recording head being divided into the nozzle blocks each composed of a plurality of nozzles; and determination means for determining for each block if the count value of said counting means has reached a predetermined value;

wherein, if there is at least one block where the count value has reached the predetermined value, preliminary ejection processing is performed for said recording head, and wherein, compressed recording data is received and wherein when the recording data is decompressed, said counting means detects the count pattern based on a result of the decompression.

8. The inkjet recording device according to claim 7 wherein either paper preliminary ejection processing or preliminary ejection processing on a recovery unit is performed at a preliminary ejection time determined by a search through the compressed data.

9. An inkjet recording device comprising:

a recording head composed of a sequence of nozzles from which ink is ejected; and head control means for ejecting ink droplets from the sequence of nozzles of said recording head based on recording data and for controlling a preliminary ejection operation to keep an ink ejection state of said recording head in good condition;

wherein said head control means comprises:

counting means that analyzes the recording data for counting a number of consecutive occurrences of a predetermined count pattern for each of nozzle blocks, said sequence of nozzles of the recording head being divided into the nozzle blocks each composed of a plurality of nozzles; and determination means for determining for each block if the count value of said counting means has reached a predetermined value;

wherein, if there is at least one block where the count value has reached the predetermined value, preliminary ejection processing is performed for said recording head, and wherein a plurality of said count patterns are set and said counting means determines that the count pattern occurs "consecutively" even when different count patterns occur consecutively.

10. An inkjet recording device comprising:

a recording head composed of a sequence of nozzles from which ink is ejected; and head control means for ejecting ink droplets from the sequence of nozzles of said recording head based on recording data and for controlling a preliminary ejection operation to keep an ink ejection state of said recording head in good condition;

wherein said head control means comprises:

counting means that analyzes the recording data for counting a number of consecutive occurrences of a predetermined count pattern for each of nozzle blocks, said sequence of nozzles of the recording head being divided into the nozzle blocks each composed of a plurality of nozzles; and determination means for determining for each block if the count value of said counting means has reached a predetermined value;

wherein, if there is at least one block where the count value has reached the predetermined value, preliminary ejection processing is performed for said recording head, and wherein said control means changes the count pattern arbitrarily in response to an external instruction.

11. An inkjet recording device comprising:

a recording head composed of a sequence of nozzles from which ink is ejected; and head control means for ejecting ink droplets from the sequence of nozzles of said recording head based on recording data and for controlling a preliminary ejection operation to keep an ink ejection state of said recording head in good condition;

wherein said head control means comprises:

counting means that analyzes the recording data for counting a number of consecutive occurrences of a predetermined count pattern for each of nozzle blocks, said sequence of nozzles of the recording head being divided into the nozzle blocks each composed of a plurality of nozzles; and determination means for determining for each block if the count value of said counting means has reached a predetermined value;

wherein, if there is at least one block where the count value has reached the predetermined value, preliminary ejection processing is performed for said recording head, and wherein, when a plurality of recording heads of the same color are used, said control means detects the count pattern in a recording data part corresponding to each recording head.

12. A recovery processing method for use in an inkjet recording device that ejects ink droplets from a sequence of nozzles of a recording head based on recording data to record an image and that performs a preliminary ejection operation for keeping an ink ejection state of said recording head in good condition, said recovery processing method comprising the steps of:

analyzing the recording data and counting a number of consecutive occurrences of a predetermined count pattern for each nozzle block, said sequence of nozzles of the recording head being divided into a plurality of nozzle blocks each composed of a plurality of nozzles, said count pattern being representative of at least one predetermined pattern of the recording data of a size corresponding to the nozzle block, a count value of said counting means being reset each time said consecutive occurrences end;

determining for each block if the count value has reached a predetermined value; and if there is at least one block where the count value has reached the predetermined value, starting preliminary ejection processing for said recording head.

* * * * *